US011511406B2

(12) United States Patent
Yang et al.

(10) Patent No.: US 11,511,406 B2
(45) Date of Patent: Nov. 29, 2022

(54) CONTROL AND PROTECTION MECHANISM AND NAIL GUN HAVING SAME

(71) Applicant: TAIZHOU DAJIANG IND. CO., LTD, Wenling (CN)

(72) Inventors: Mingjun Yang, Wenling (CN); Jinquan Huang, Wenling (CN); Min Li, Wenling (CN); Zhonghai Song, Wenling (CN); Guicong Xiao, Wenling (CN)

(73) Assignee: TAIZHOU DAJIANG IND. CO., LTD, Wenling (CN)

( * ) Notice: Subject to any disclaimer, the term of this patent is extended or adjusted under 35 U.S.C. 154(b) by 332 days.

(21) Appl. No.: 16/996,100

(22) Filed: Aug. 18, 2020

(65) Prior Publication Data

US 2021/0060748 A1 Mar. 4, 2021

(30) Foreign Application Priority Data

Aug. 26, 2019 (CN) ..... 201921395863.8
Aug. 26, 2019 (CN) ..... 201921395865.7
(Continued)

(51) Int. Cl.
*B25C 1/04* (2006.01)
*B25C 1/00* (2006.01)

(52) U.S. Cl.
CPC ..... *B25C 1/047* (2013.01); *B25C 1/001* (2013.01); *B25C 1/008* (2013.01)

(58) Field of Classification Search
CPC .. B25C 1/047; B25C 1/04; B25C 1/06; B25C 1/001; B25C 1/008; B25C 1/041; B25C 1/043
See application file for complete search history.

(56) References Cited

U.S. PATENT DOCUMENTS

2015/0129630 A1* 5/2015 Matsuno ..... B25C 1/06 227/130
2017/0209995 A1* 7/2017 Iijima ..... B25C 1/043
2020/0398412 A1* 12/2020 Yasutomi ..... B25C 1/047

FOREIGN PATENT DOCUMENTS

CN 208867117 U * 5/2019
CN 208867117 U 5/2019

OTHER PUBLICATIONS

Pu, Machine Translation of CN 208867117 U (Year: 2022).*

* cited by examiner

*Primary Examiner* — Anna K Kinsaul
*Assistant Examiner* — Veronica Martin
(74) *Attorney, Agent, or Firm* — Locke Lord LLP; Tim Tingkang Xia, Esq.

(57) ABSTRACT

A control and protection mechanism and a nail gun having the same. The control and protection mechanism includes first and second micro-motion switches, a toggle block, a lock pin, an actuating member, a micro-motion contact and a driving rod. The switch bracket is attached to the main body; the first and second micro-motion switches are fixed on the switch bracket; the toggle block is rotatably attached to the switch bracket, and includes a lock groove, a trigger end and a toggle end. The toggle end is operably coupled to the first micro-motion switch and the trigger end extends into inside the main body such that when the piston moves in the cylinder to a position, the piston pushes the trigger end to prompt the toggle block to rotate and therefore the toggle end to move, thereby causing the first micro-motion switch to change its switch state.

18 Claims, 16 Drawing Sheets

(30) Foreign Application Priority Data

| | | |
|---|---|---|
| Aug. 26, 2019 | (CN) | 201921395877.X |
| Dec. 30, 2019 | (CN) | 201922486372.0 |
| Dec. 30, 2019 | (CN) | 201922486429.7 |
| Dec. 30, 2019 | (CN) | 201922488911.4 |

CONTROL AND PROTECTION MECHANISM AND NAIL GUN HAVING SAME

CROSS-REFERENCE TO RELATED PATENT APPLICATIONS

This application claims priority to and benefit of Chinese Patent Application Nos. 201921395863.8 filed Aug. 26, 2019; 201921395865.7 filed Aug. 26, 2019; 201921395877.X filed Aug. 26, 2019; 201922486372.0 filed Dec. 30, 2019; 201922486429.7 filed Dec. 30, 2019; and 201922488911.4 filed Dec. 30, 2019 in the State Intellectual Property Office of P.R. China, which are hereby incorporated by reference in their entireties.

FIELD OF THE INVENTION

This invention relates generally to nail guns, and more particularly to a control and protection mechanism and a nail gun having the same.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

Nail guns are commonly used hand-held processing tools in the fields of construction and decoration. Conventionally, the nail guns are mostly pneumatic nail guns. A pneumatic nail gun generally utilizes compressed high pressure air in an air pressure chamber to actuate the striking pin to push a nail out of a nail muzzle and thus needs a source of the compressed air. Usually, the pneumatic nail gun is connected with auxiliary equipment such as an air compressor for providing compressed air to the air pressure chamber through a special air-line during operation. They are restricted by the air-line length when working, which is not convenient in certain circumstances.

Electrical nail guns are also available commercially, which operate using electrical energy. One type of the electrical nail guns is through the use of solenoid driven mechanisms in which the force provided by a solenoid is governed by the number of ampere-turns in the solenoid. In order to obtain the high forces required for driving nails into a work piece, a large number of turns are required in addition to high current pulses. These requirements are counterproductive as the resistance of the coil increases in direct proportion to the length of the wire in the solenoid windings. This type of the electrical nail guns limits most solenoid driven mechanisms to short stroke small load applications.

Therefore, a heretofore unaddressed need exists in the art to address the aforementioned deficiencies and inadequacies.

SUMMARY OF THE INVENTION

In one aspect, the invention relates to a control and protection mechanism used for a nail gun having a main body having an energy storage mechanism including a cylinder, and a striking mechanism having a piston disposed in the cylinder and a nail striking member co-movably connected to the piston.

The control and protection mechanism includes a first micro-motion switch, a second micro-motion switch, a switch bracket, a toggle block, a lock pin, an actuating member, a micro-motion contact and a driving rod, wherein the switch bracket is attached to the main body; the first micro-motion switch and the second micro-motion switch are fixed on the switch bracket; the toggle block is rotatably attached to the switch bracket, and includes a lock groove, a trigger end and a toggle end, wherein the toggle end is operably coupled to the first micro-motion switch and the trigger end extends into inside the main body such that when the piston moves in the cylinder to a position, the piston pushes the trigger end to prompt the toggle block to rotate and therefore the toggle end to move, thereby causing the first micro-motion switch to change its switch state; the lock pin is movably attached to the switch bracket and operably extends into the lock groove to prevent the toggle block from rotating; the actuating member is attached to a front end of the driving rod and extends to a front end of the main body; the reset element being in contact with the driving rod for driving the drive rod and the actuating member to reset; and the driving rod having the micro-motion contact at a rear end facing the second micro-motion switch is attached to the switch bracket and the main body.

In one embodiment, the driving rod has a sliding groove formed proximate to the micro-motion contact, and the lock pin has a push block formed at one end and extending into the sliding groove.

In one embodiment, the first micro-motion switch is a normally closed switch, and the second micro-motion switch is a normally open switch.

In one embodiment, the control and protection mechanism further comprises a drive element disposed at one end of the lock pin for driving the lock pin to move.

In one embodiment, the control and protection mechanism further comprises a fixed bracket disposed on the main body such that the reset element is located between the fixed bracket and the driving rod, and the drive element is located between the lock pin and the fixed bracket.

In one embodiment, the reset element is a reset spring, and the drive element is a drive spring, the maximum elastic force of the reset spring is greater than that of the drive spring.

In one embodiment, the actuating member includes a pressing piece at the front end, and the front end of the main body is provided with a muzzle, an outer end of the pressing piece extends out of the muzzle.

In one embodiment, the control and protection mechanism further comprises an adjustment component including an adjustment screw and an adjustment nut, wherein the front end of the driving rod is connected to the actuating member through an adjustment component, wherein the drive rod is connected to the adjustment nut, and the actuating member is connected to the adjusting screw.

In another aspect, the invention relates to a nail gun. In one embodiment, the nail gun includes a main body comprising an energy storage mechanism at a rear end portion and a muzzle at a front end portion, wherein the energy storage mechanism comprises a cylinder defined in the rear end portion of the main body and at least one spring 71 disposed in the cylinder; a striking mechanism comprising a piston disposed in the cylinder, a nail striking member co-movably connected to the piston, and a driving member operably alternatively engaged and disengaged with the nail striking member, wherein an engagement of the driving member with the nail striking member causes the piston to move backward in the cylinder to push the at least one spring into a contract state so as to store energy therein, and an disengagement of the driving member with the nail striking member causes the least one spring to release the stored energy therein to push the piston to move frontward in the cylinder so that the nail striking member is co-moved therewith to strike a nail out of a muzzle; and a control and protection mechanism for controlling and protecting the operation of the nail gun, In one embodiment, the control and protection mechanism comprises a first micro-motion switch, a second micro-motion switch, a switch bracket, a toggle block, a lock pin, an actuating member, a micro-motion contact and a driving rod, wherein the switch bracket is attached to the main body; the first micro-motion switch and the second micro-motion switch are fixed on the switch bracket; the toggle block is rotatably attached to the switch bracket, and includes a lock groove, a trigger end and a toggle end, wherein the toggle end is operably coupled to the first micro-motion switch and the trigger end extends into inside the main body such that when the piston moves in the cylinder to a position, the piston pushes the trigger end to prompt the toggle block to rotate and therefore the toggle end to move, thereby causing the first micro-motion switch to change its switch state; the lock pin is movably attached to the switch bracket and operably extends into the lock groove to prevent the toggle block from rotating; the actuating member is attached to a front end of the driving rod and extends to a front end of the main body; the reset element being in contact with the driving rod for driving the drive rod and the actuating member to reset; and the driving rod having the micro-motion contact at a rear end facing the second micro-motion switch is attached to the switch bracket and the main body.

In one embodiment, the driving rod has a sliding groove formed proximate to the micro-motion contact, and the lock pin has a push block formed at one end and extending into the sliding groove.

In one embodiment, the first micro-motion switch is a normally closed switch, and the second micro-motion switch is a normally open switch.

In one embodiment, the control and protection mechanism further comprises a drive element disposed at one end of the lock pin for driving the lock pin to move.

In one embodiment, the control and protection mechanism further comprises a fixed bracket disposed on the main body such that the reset element is located between the fixed bracket and the driving rod, and the drive element is located between the lock pin and the fixed bracket.

In one embodiment, the reset element is a reset spring, and the drive element is a drive spring, the maximum elastic force of the reset spring is greater than that of the drive spring.

In one embodiment, the actuating member includes a pressing piece at the front end, and the front end of the main body is provided with a muzzle, an outer end of the pressing piece extends out of the muzzle.

In one embodiment, the control and protection mechanism further comprises an adjustment component including an adjustment screw and an adjustment nut, wherein the front end of the driving rod is connected to the actuating member through an adjustment component, wherein the drive rod is connected to the adjustment nut, and the actuating member is connected to the adjusting screw.

In one embodiment, the control and protection mechanism comprises a switch bracket and a drive rod disposed on the main body, wherein the switch bracket comprises a micro-motion switch, the drive rod comprises a micro-motion contact facing the micro-motion switch, a stop and a first return spring disposed between the micro-motion contact and the stop.

In one embodiment, the front end of the driving rod passes through the connection member and is connected to an actuating member through a connecting assembly, wherein the connecting assembly comprises a fixed sleeve connected to the connection member, an adjusting rod disposed in the fixed sleeve, a tightening sleeve rotatably connected to the fixed sleeve and setting on the outer side of the adjusting rod, a fixing tube disposed between the adjusting rod and the tightening sleeve, and a second return spring sleeved on the outer side of the fixing tube, wherein an outer end of the adjusting rod is connected to the actuating member.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
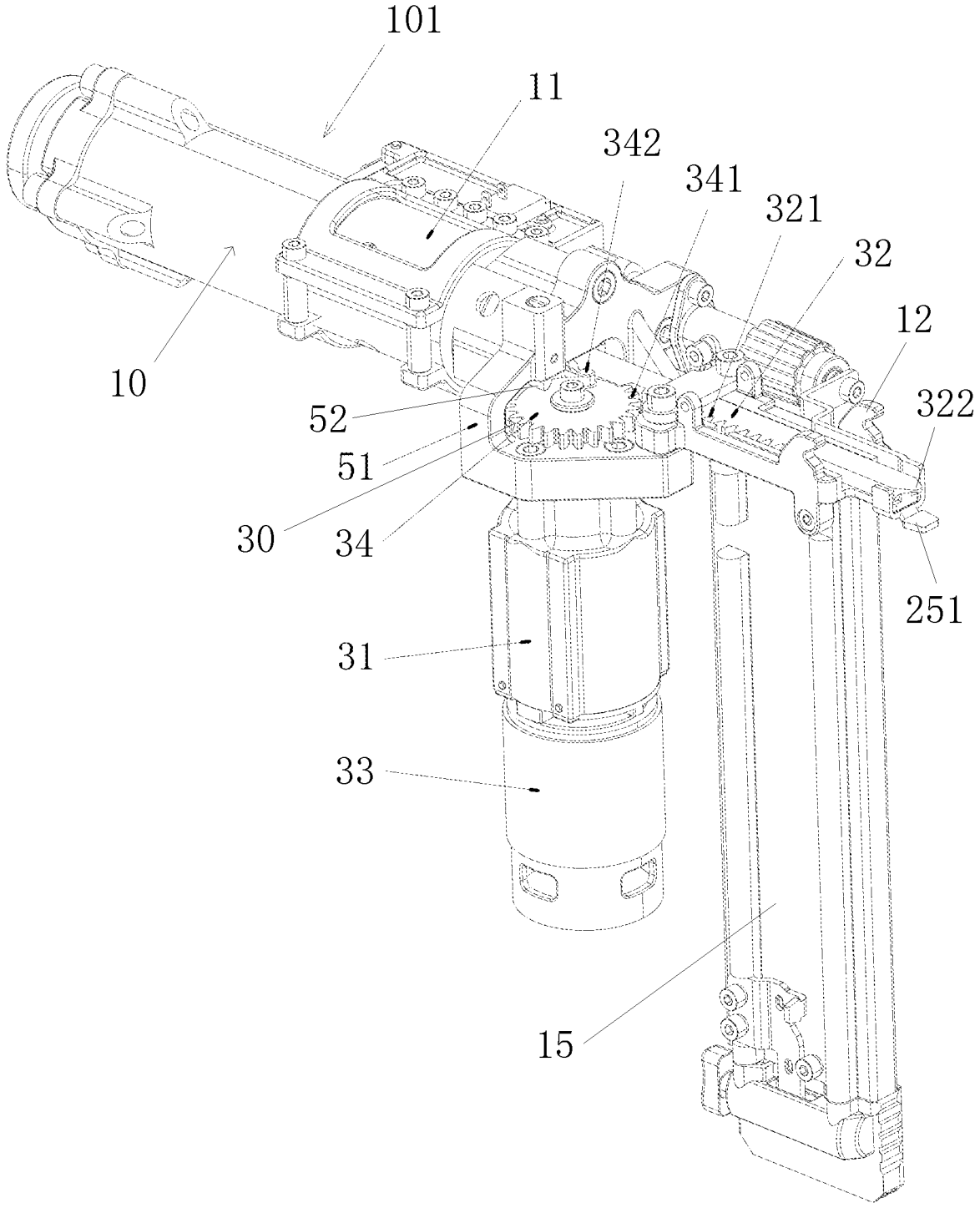
FIG. 1 shows a perspective view of a nail gun according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this invention will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed may be resorted to by those skilled in the art, and that such modifications and variations are considered to be within the scope of this invention as defined by the appended claims.

Whenever a range is given in the specification, for example, a temperature range, a time range, or a composition or concentration range, all intermediate ranges and subranges, as well as all individual values included in the ranges given are intended to be included in the invention. It will be understood that any subranges or individual values in a range or subrange that are included in the description herein can be excluded from the claims herein.

It will be understood that, as used in the description herein and throughout the claims that follow, the meaning of "a", "an", and "the" includes plural reference unless the context clearly dictates otherwise. Thus, for example, reference to "a cell" includes a plurality of such cells and equivalents thereof known to those skilled in the art. As well, the terms "a" (or "an"), "one or more" and "at least one" can be used interchangeably herein. It is also to be noted that the terms "comprising", "including", and "having" can be used interchangeably.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising", or "includes" and/or "including", or "has" and/or "having", or "carry" and/or "carrying", or "contain" and/or "containing", or "involve" and/or "involving", "characterized by", and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

As used in the disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in the disclosure, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

In accordance with the purposes of this invention, as embodied and broadly described herein, this invention, in certain aspects, relates to a drive control and protection mechanism and a nail gun with the drive control and protection mechanism. Embodiments of the invention are now described in conjunction with the accompanying drawings in FIGS. 1-20.

Figure 18:
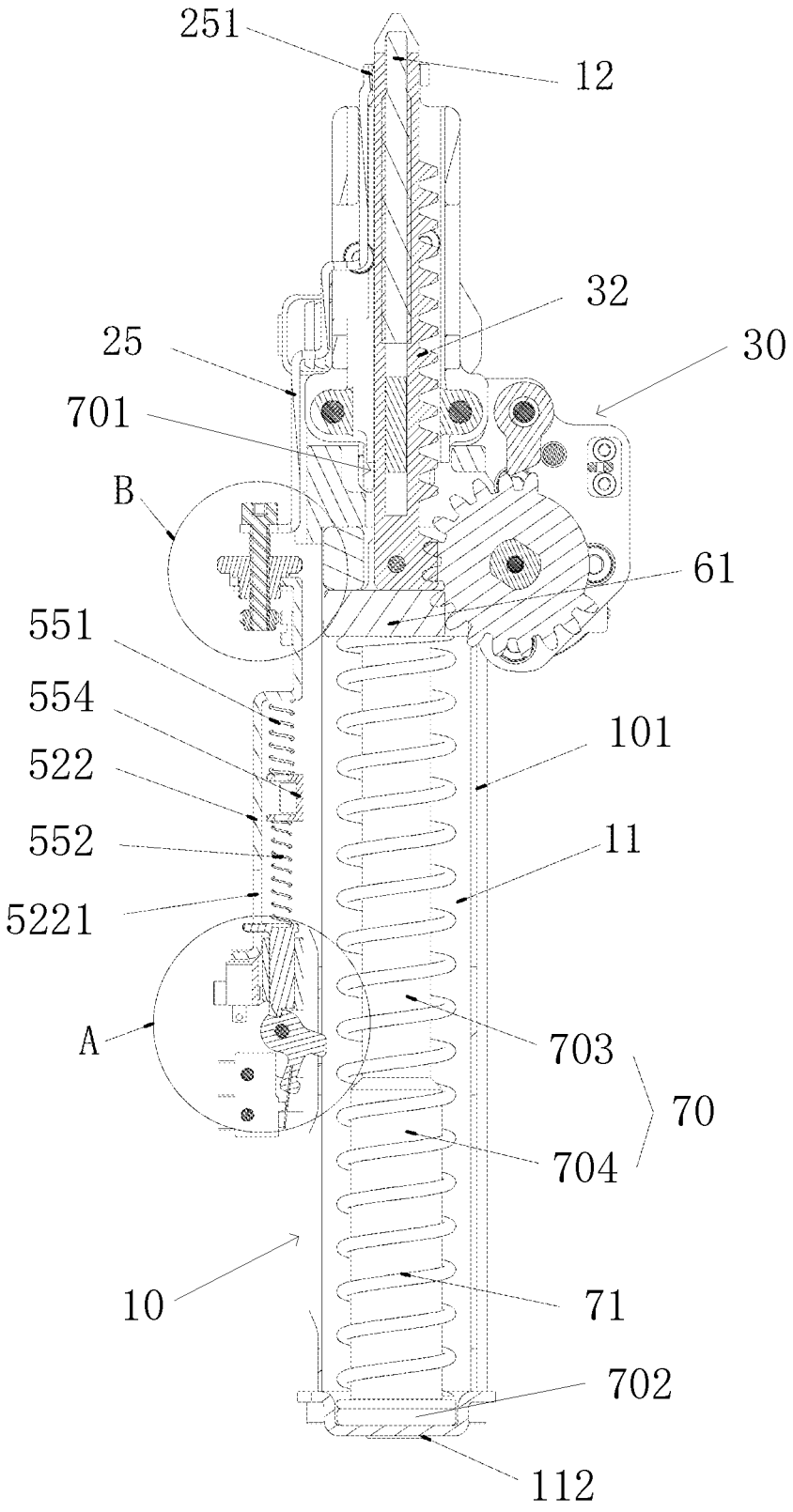
FIG. 18 shows a cross-sectional view of a nail gun according to one embodiment of the invention.
Figure 19:
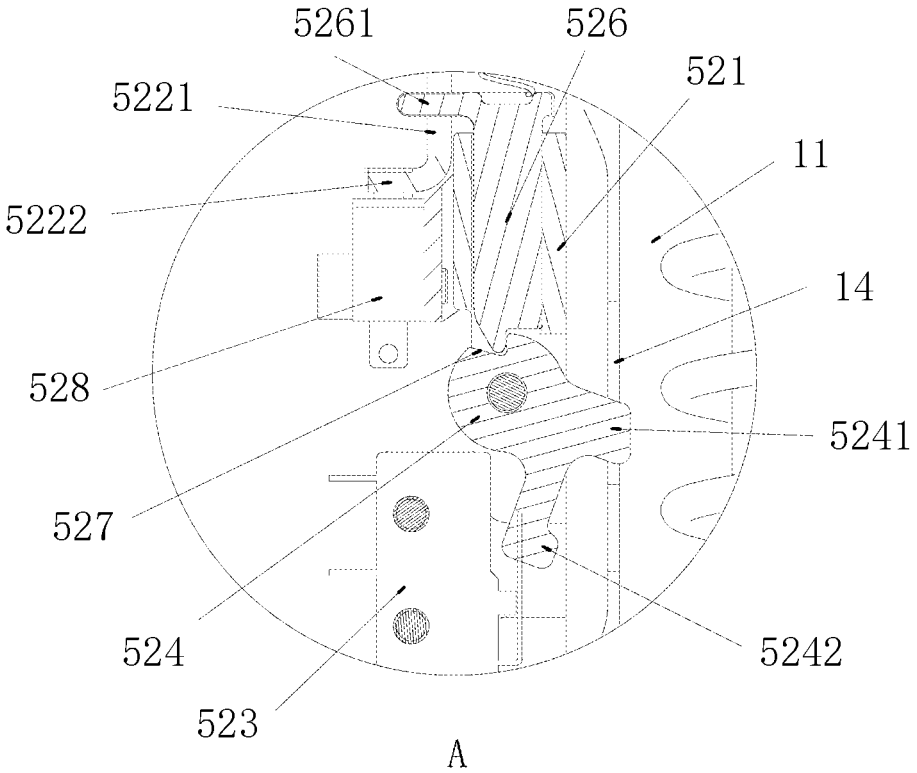
FIG. 19 shows a cross-sectional view of a drive control and protection mechanism/device used in a nail gun according to one embodiment of the invention.
Figure 20:
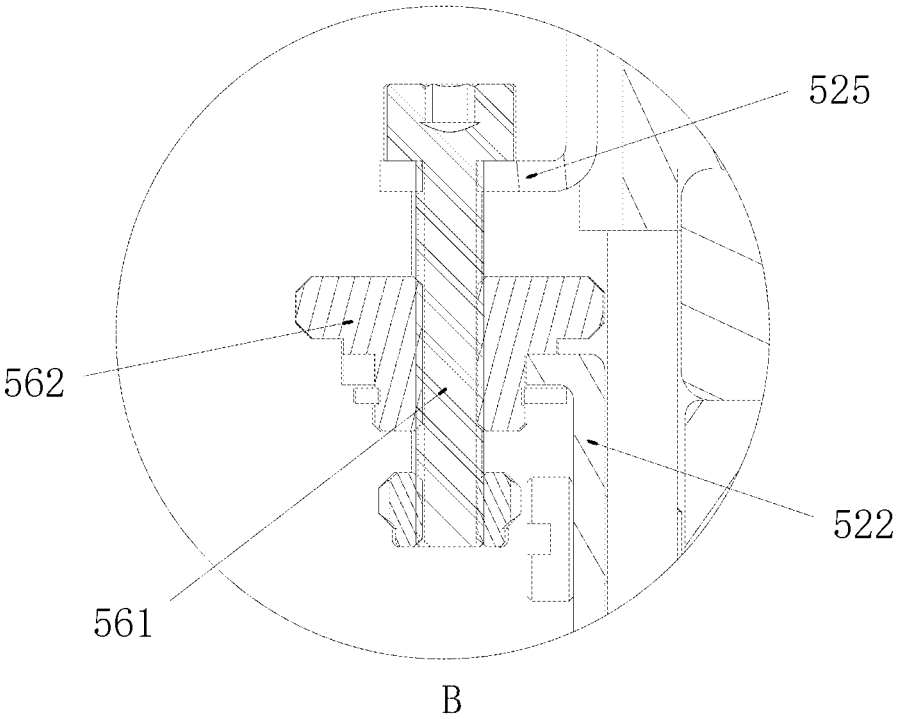
FIG. 20 shows a cross-sectional view of a drive control and protection mechanism/device used in a nail gun according to one embodiment of the invention.

Referring to FIGS. 18-20, the control and protection mechanism is used for a nail gun having a main body 101 having an energy storage mechanism 10 including a cylinder 11, and a striking mechanism 30 having a piston 61 disposed in the cylinder and a nail striking member 32 co-movably connected to the piston 61, and includes a first micro-motion switch 523, a second micro-motion switch 528, a switch bracket 521, a toggle block 524, a lock pin 526, an actuating member 25, a micro-motion contact 222 and a driving rod 522.

The switch bracket 521 is attached to the main body 101. The first micro-motion switch 523 and the second micro-motion switch 528 are fixed on the switch bracket 521. The toggle block 524 is rotatably attached to the switch bracket 521, and includes a lock groove 527, a trigger end 5241 and a toggle end 5242, wherein the toggle end 5242 is operably coupled to the first micro-motion switch 523 and the trigger end 5241 extends into inside the main body 101 such that when the piston 61 moves in the cylinder to a position, the piston 61 pushes the trigger end 5241 to prompt the toggle block 524 to rotate and therefore the toggle end 5242 to move, thereby causing the first micro-motion switch 523 to change its switch state. The lock pin 526 is movably attached to the switch bracket 521 and operably extends into the lock groove 527 to prevent the toggle block from rotating. The actuating member 25 is attached to a front end of the driving rod 522 and extends to a front end of the main body 101. The reset element being in contact with the driving rod for driving the drive rod 522 and the actuating member 25 to reset. The driving rod 522 having the micro-motion contact 5222 at a rear end facing the second micro-motion switch 528 is attached to the switch bracket 521 and the main body 101.

The driving rod 522 has a sliding groove 5221 formed proximate to the micro-motion contact 5222, and the lock pin 526 has a push block 261 formed at one end and extending into the sliding groove 5221.

The first micro-motion switch 523 is a normally closed switch, and the second micro-motion switch 528 is a normally open switch.

The control and protection mechanism further includes a drive element 552 disposed at one end of the lock pin 526 for driving the lock pin 526 to move.

The control and protection mechanism also includes a fixed bracket 554 disposed on the main body 101 such that the reset element 551 is located between the fixed bracket 554 and the driving rod 522, and the drive element 552 is located between the lock pin 526 and the fixed bracket 554. The reset element 551 is a reset spring 551, and the drive element 552 is a drive spring 552, the maximum elastic force of the reset spring 551 is greater than that of the drive spring 552.

The actuating member 25 includes a pressing piece 251 at the front end, and the front end of the main body 101 is provided with a muzzle 12, an outer end of the pressing piece 251 extends out of the muzzle 12.

The control and protection mechanism further has an adjustment component including an adjustment screw 561 and an adjustment nut 562, wherein the front end of the driving rod 522 is connected to the actuating member 25 through an adjustment component, wherein the drive rod 522 is connected to the adjustment nut 562, and the actuating member 25 is connected to the adjusting screw 561.

In certain embodiments, as shown in FIGS. 1-2 and 8-11, he control and protection mechanism 20 comprises a switch bracket 21 and a drive rod 22 disposed on the main body 101, wherein the switch bracket 21 comprises a micro-motion switch 28, the drive rod 22 comprises a micro-motion contact 222 facing the micro-motion switch 28, a stop 223 and a first return spring 262 disposed between the micro-motion contact 222 and the stop 223.

The front end of the driving rod 22 passes through the connection member 51 and is connected to an actuating member 25 through a connecting assembly, wherein the connecting assembly comprises a fixed sleeve 291 connected to the connection member 51, an adjusting rod 292 disposed in the fixed sleeve 291, a tightening sleeve 293 rotatably connected to the fixed sleeve 291 and setting on the outer side of the adjusting rod 292, a fixing tube 294 disposed between the adjusting rod 292 and the tightening sleeve 293, and a second return spring 263 sleeved on the outer side of the fixing tube 294, wherein an outer end of the adjusting rod 292 is connected to the actuating member 25.

FIGS. 1-20 show various embodiments of a nail gun according to the invention. The nail gun includes a main body 101, an energy storage mechanism 10, a driving mechanism 30, a nail magazine assembly 15, and a control and protection mechanism for controlling and protecting the operation of the nail gun, as shown in FIGS. 1-3, 13-15, 17-19.

The energy storage mechanism 10 is provided at a rear end portion of the main body 101 and a muzzle 12 is provided at a front end portion of the main body 101. The energy storage mechanism 10 comprises a cylinder 11 defined in the rear end portion of the main body 101 and at least one spring 71 disposed in the cylinder 11.

The nail magazine assembly 15 is adapted for accommodating a nail plate, assembled below the muzzle 12 and operably coupled to the muzzle 12 for conveying nails.

The driving mechanism 30 includes a striking structure, a driving member 34 coupled to the striking structure, a gear reducer 3, and a motor 33 coupled to the driving member 34 through the gear reducer 31. The striking structure has a piston 61 disposed in the cylinder 11 and a nail striking member 32 co-movably connected to the piston 61. The driving member 34 is operably alternatively engaged and disengaged with the nail striking member 32.

As such, an engagement of the driving member 34 with the nail striking member 34 causes the piston 61 to move backward in the cylinder 11 to push the at least one spring 71 into a contract state so as to store energy therein, and an disengagement of the driving member 34 with the nail striking member 32 causes the least one spring 71 to release the stored energy therein to push the piston 61 to move frontward in the cylinder 11 so that the nail striking member 34 is co-moved therewith to strike a nail out of the muzzle 12.

Figure 2:
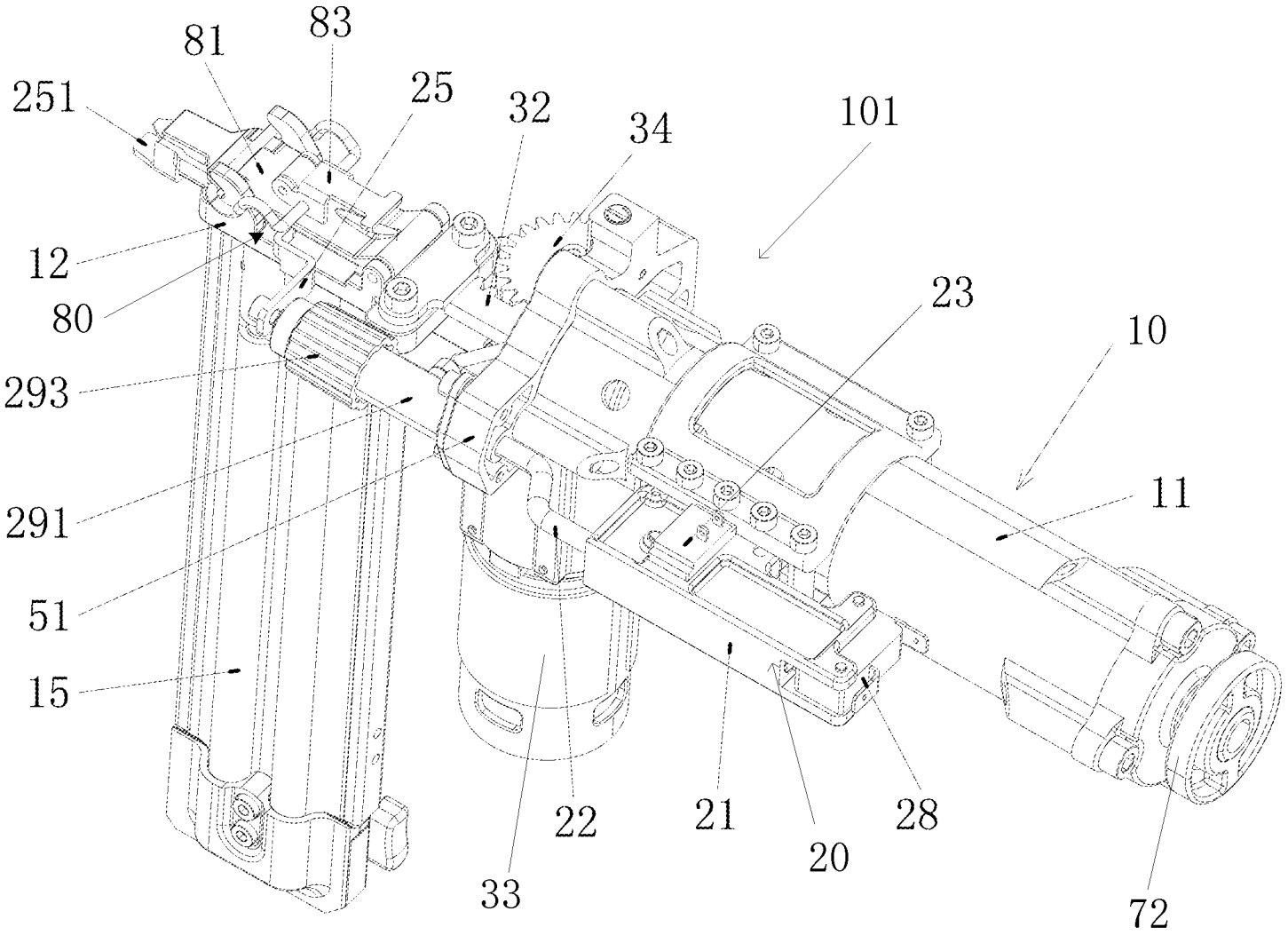
FIG. 2 shows another perspective view of a nail gun according to one embodiment of the invention.
Figure 3:
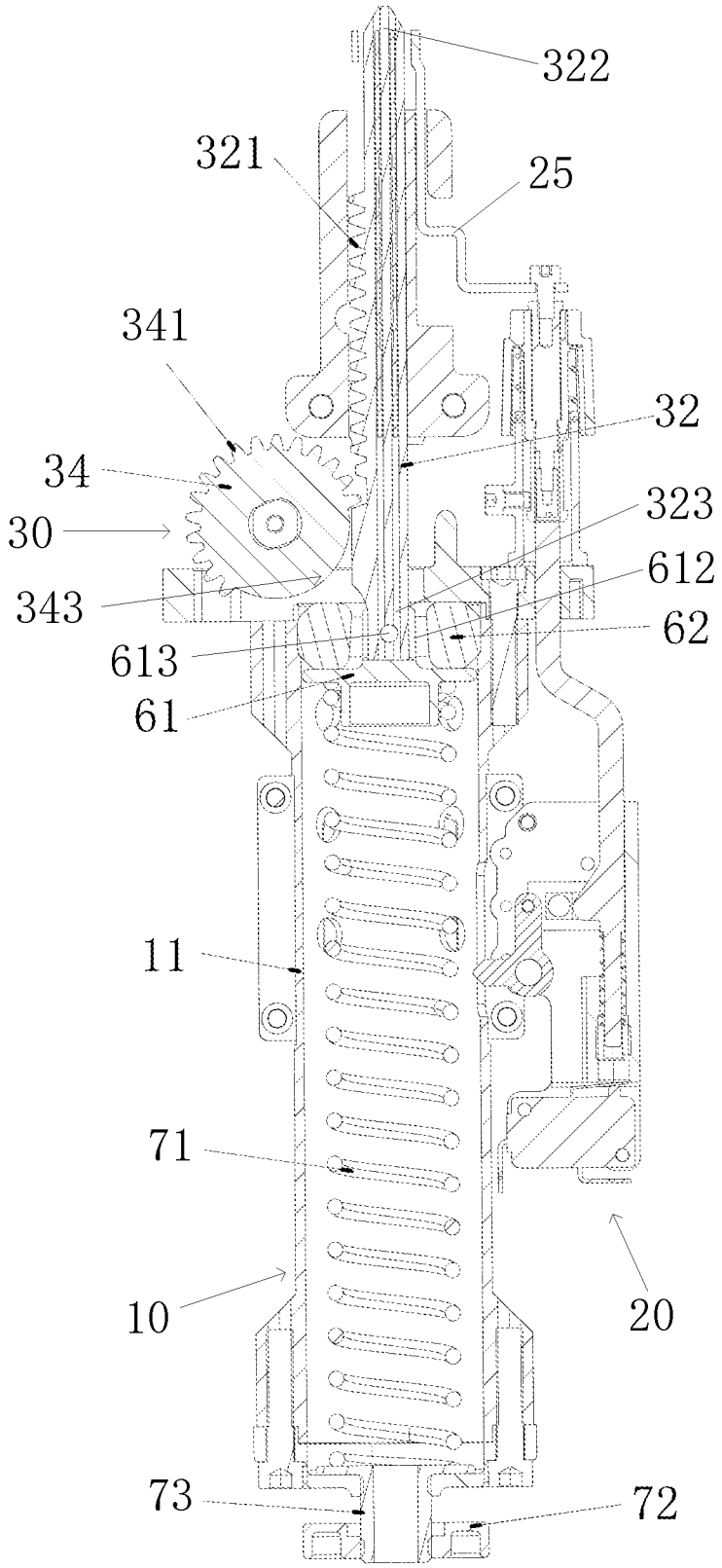
FIG. 3 shows a cross-sectional view of a nail gun according to one embodiment of the invention.
Figure 12:
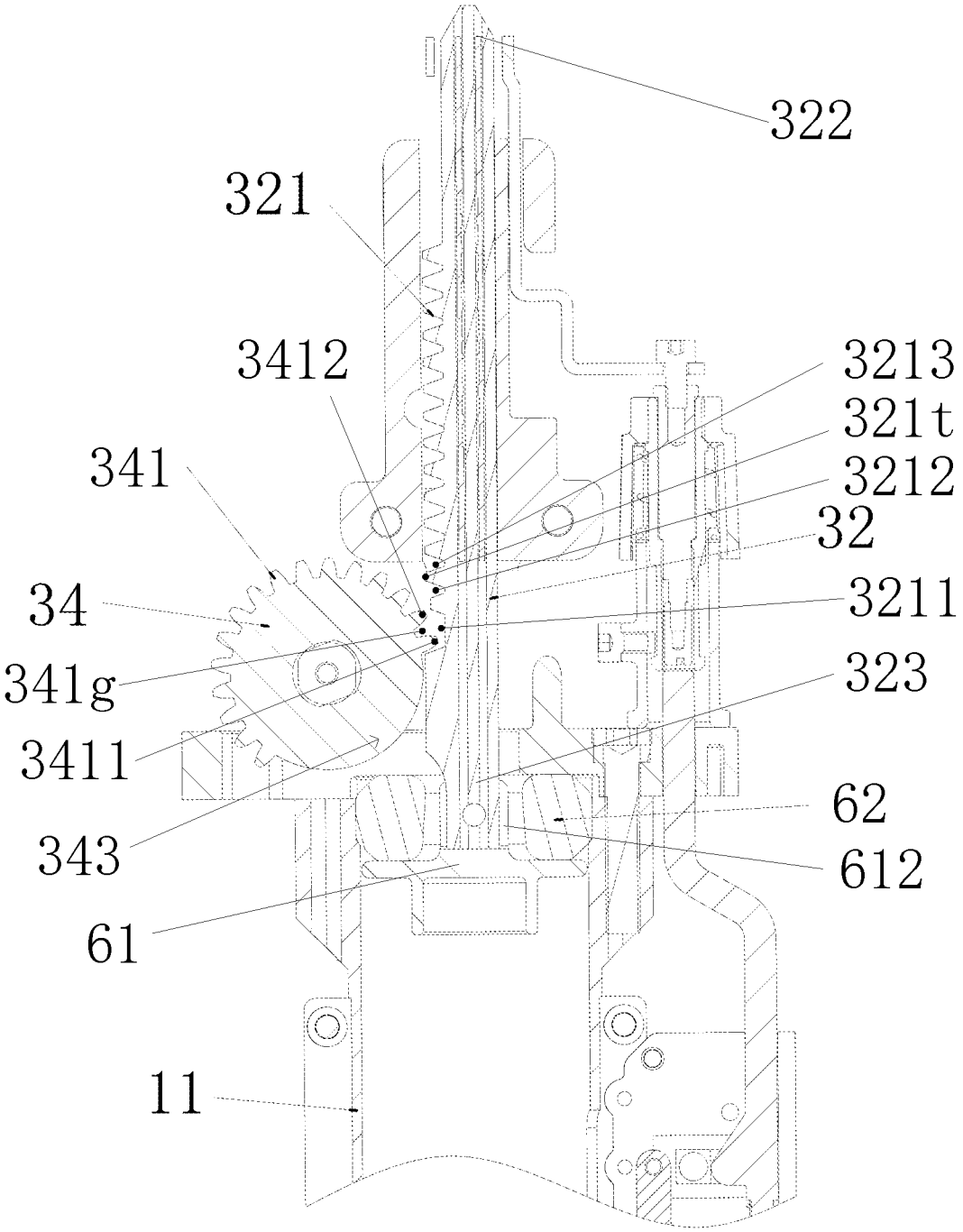
FIG. 12 shows a partially cross-sectional view of a nail gun according to one embodiment of the invention.
Figure 14:
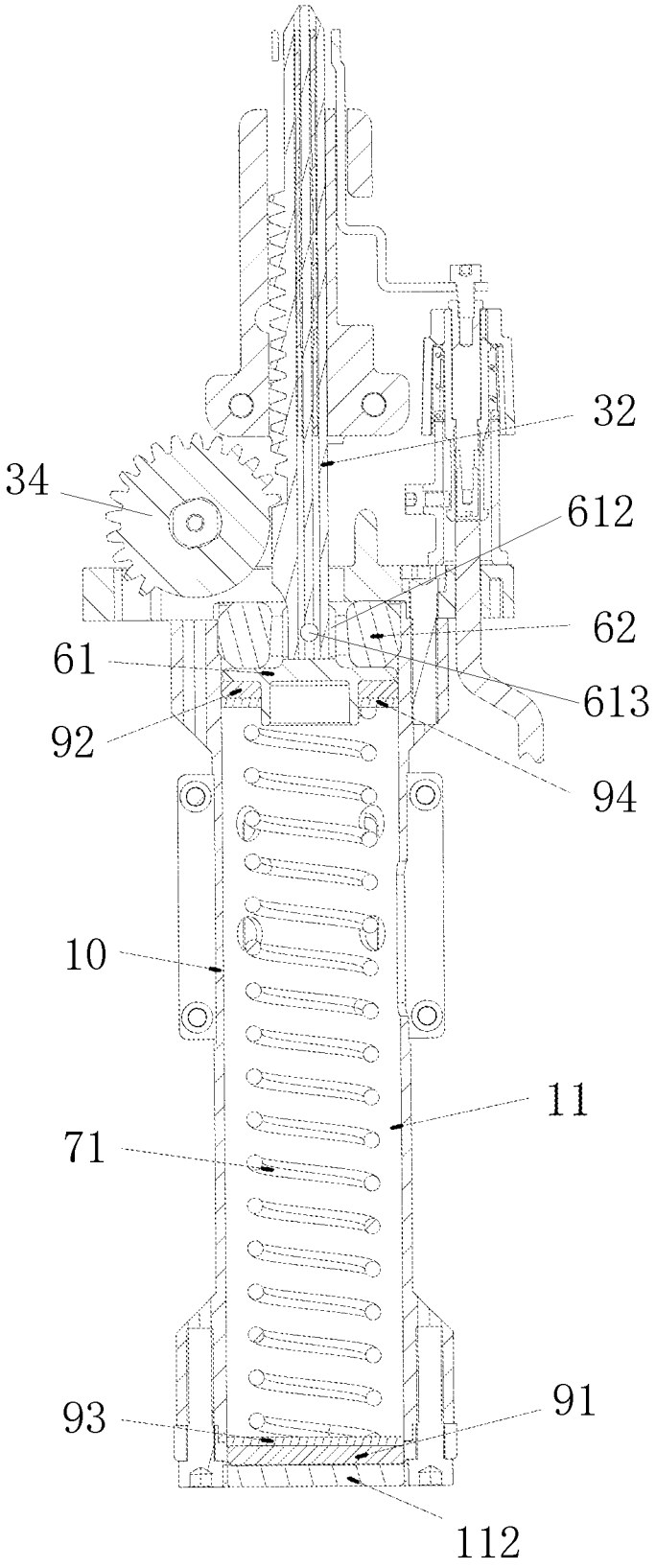
FIG. 14 shows a cross-sectional view of a nail gun according to one embodiment of the invention.

FIGS. 1-5, 12 and 14 show the specific structure of the drive mechanism 30 according to embodiments of the invention. The nail striking member 32 includes a front end portion 322 acting as a striking pin 32, a rear end portion 323 connected to the piston 61, and a plurality of tooth grooves 231 defined on a lateral side and located between the front end portion 322 and the rear end portion 323. In other words, a tooth or ridge (e.g., 321*t* in FIG. 12) is formed between two adjacent tooth grooves (e.g., 3212 and 3213 in FIG. 12). That is, a tooth/ridge and a tooth groove are alternately defined in the lateral side of the striking pin 32, as shown in FIGS. 3, 12 and 14.

The driving member 34 is a wheel-like structure with a tooth portion 341 having a plurality of teeth (or ridges) 341 and a non-tooth portion 343 defined in the rim of the wheel-like structure, as shown in FIGS. 3, 4, 12 and 14. The teeth 341 are formed on the circumferential rim of the driving member 34. Similarly, a tooth groove (e.g., 341*g* in FIG. 12) is formed between two adjacent teeth (e.g., 3411 and 3412 in FIG. 12). That is, a tooth and a tooth groove are alternately defined in the tooth portion 341. The portion of the teeth 341 is nearly two-thirds of the circumferential rim, which constitutes the tooth portion 341. The remaining portion of the circumferential rim constitutes the non-tooth portion 343.

In some embodiments, the number of the teeth 341 of the driving member 34 matches the number of the tooth grooves 321 on the nail striking member 32, which enables a one-way rotation of the driving member 34. When the plurality of teeth 341 of the driving member 34 operably meshes with the plurality of teeth grooves 321 of the nail striking member 32, the driving member 34 is engaged with the nail striking member 32. When the plurality of teeth 341 does not mesh with the plurality of teeth grooves 321, the driving member 34 is disengaged with the nail striking member 32.

In other embodiments, as shown in FIGS. 12 and 14, a first tooth groove 3211 on the nail striking member 32 has a size being two times larger than that of the other tooth grooves (e.g., 3212 and 3213) on the nail striking member 32, i.e., no tooth is formed between first and second tooth grooves on the nail striking member 32. In the exemplary embodiments, the number of the tooth grooves 321 on the nail striking member 32 is one number less than the number of the teeth 341 of the driving member 34. When the plurality of teeth 341 of the driving member 34 operably meshes with the plurality of teeth grooves 321 of the nail striking member 32, the first and second teeth 3411 and 3412 are first received in the first groove 3211, and the driving member 34 is engaged with the nail striking member 32. When the plurality of teeth 341 does not mesh with the plurality of teeth grooves 321, the driving member 34 is disengaged with the nail striking member 32. Such tooth groove design of the nail striking member 32 can greatly reduce the scratching phenomenon between the grooves (or teeth) of the nail striking member 32 and the teeth (or grooves) of the driving member 34 occurred when the teeth 341 of the driving member 34 are not meshed well with the teeth grooves 321 of the nail striking member 32 in the case of which a nail is not fully nailed into the surface of the nailing position.

The driving member 34 is a wheel-like structure with a tooth portion 341 having a plurality of teeth 341 and a non-tooth portion 343 defined in the rim of the wheel-like structure, as shown in FIGS. 3, 4, 12 and 14. The teeth 341 are formed on the circumferential rim of the driving member 34, the portion of the teeth 341 is nearly two-thirds of the circumferential rim, which constitutes the tooth portion 341. The remaining portion of the circumferential rim constitutes the non-tooth portion 343. The number of the teeth 341 matches the number of the tooth grooves 321 on the nail striking member 32, which enables a one-way rotation of the driving member 34.

When the plurality of teeth 341 operably meshes with the plurality of teeth grooves 321, the driving member 34 is engaged with the nail striking member 34. When the plurality of teeth 341 does not mesh with the plurality of teeth grooves 321, the driving member 34 is disengaged with the nail striking member 34.

The driving member 34 is operably driven by the motor 33. When the teeth 341 and the tooth groove 321 are meshed/engaged with each other, the nail striking member 32 is driven to move in the muzzle 12, and the rear end 323 of the nail striking member 32 moves toward the rear end cover 112 of the cylinder 11 to push the spring 71 of the energy storage mechanism/device 10, so that the spring 71 subjects to a certain pressure. When the driving member 34 is further rotated to a certain position where the nail striking member 32 reaches the maximum stroke, the teeth 341 and the tooth groove 321 are disengaged with each other and the driving force to the nail striking member 32 is lost. Meantime, the pressure exerted on the spring 71 reaches a critical value, the spring 71 moves from the contract state toward its expend state in which the spring 71 is stretched to have a longest length, the restoring force generated when the spring 71 of the energy storage mechanism/device 10 is stretched/expanded can push the piston 61 therefore the front end 322 of the nail striking member 32 toward the muzzle 12, thereby driving out a nail. It should be appreciated that the spring 71 can be one spring or more springs.

As shown in FIGS. 1-2, the gear reducer 31 is provided on the output shaft of the motor 33, the drive wheel 34 is connected to the speed reducer 31, the axis of the drive wheel 34 and the movement direction of the nail striking member 32 are perpendicular to each other, i.e., in a vertical setting. Such vertical setting allows the motor 33 to be located in the same direction as the nail magazine assembly 15, making the entire nail gun layout reasonable and convenient for handling.

Figure 4:
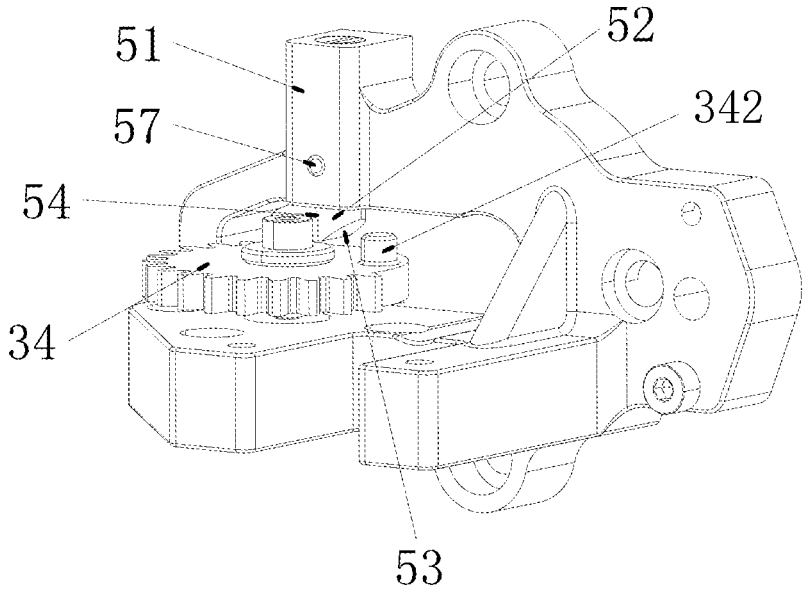
FIG. 4 shows a perspective view of a connecting member used in a nail gun according to one embodiment of the invention.
Figure 5:
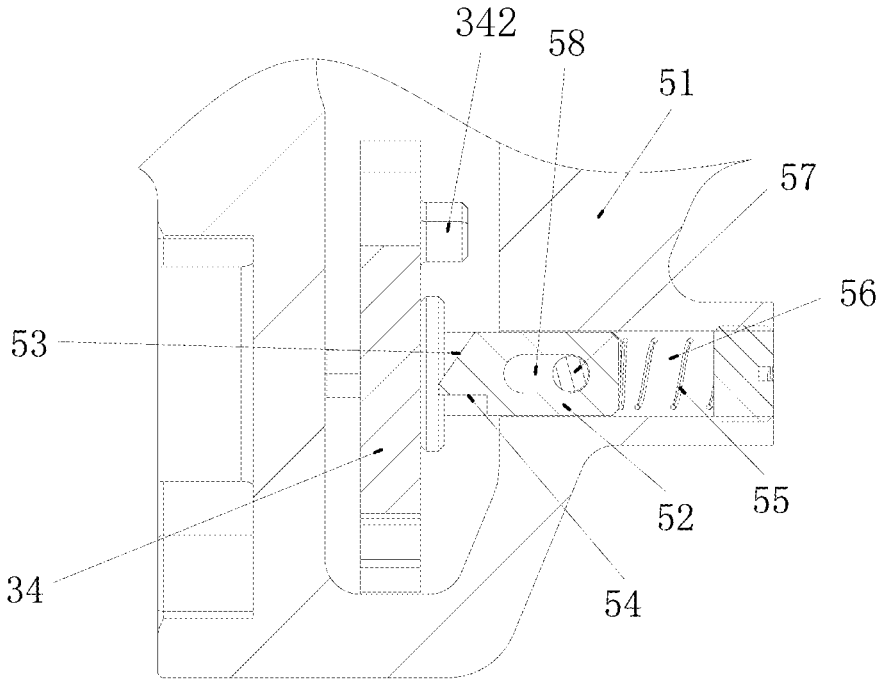
FIG. 5 shows a cross-sectional view of the connecting member shown in FIG. 3.

As shown in FIGS. 3-5, the driving mechanism 30 further includes a position limiting mechanism provided on one side of the driving member 34. The position limiting mechanism includes a connection member 51 disposed on the main body 101 between the energy storage mechanism 10 and the muzzle 12 and a limiting protrusion 342 formed on the driving member 34. The connection member 51 includes a limiting pin 52 operably interacting with the limiting protrusion 342 of the driving member 34. The limiting pin 52 has an inclined guide surface 53 formed on one side of the limiting pin 52 and a limiting surface 54 formed on the other side of the limiting pin 52. A return spring 55 is provided between an inner end of the limiting pin 52 and the connection member 51. When the driving member 34 rotates under the drive of the motor 31, the limiting protrusion 342 moves against the inclined guide surface 53, under the thrust of the limiting protrusion 342, the limiting pin 52 responsively moves upward at this moment, then further rotations of the driving member 34 causes the limiting protrusion 342 to leave the limiting pin 52, the limiting pin 52 is moved downward and reset by the elastic force of the return spring 55. At this time, the limiting surface 54 faces the limiting protrusion 342. The limit surface is L-shaped, which can avoid the driving ember 34 reverses, thereby restricting the direction of rotation of the driving member 34.

The connection member 51 has a mounting hole 56 defined at one side. The return spring 55 and the limiting pin 52 are located in the mounting hole 56. The limiting pin 52 is connected to the connection member 51 through a fixing pin 57. The limiting pin 52 is provided with a sliding groove 58 through which the fixing pin 57 passes. The setting of the sliding groove 58 limits the movement of the limiting pin 52 in the mounting hole 56 so as to avoid excessive deformation of the return spring 55 caused by excessive movement thereof, and to a certain extent, plays a protective role.

Figure 6:
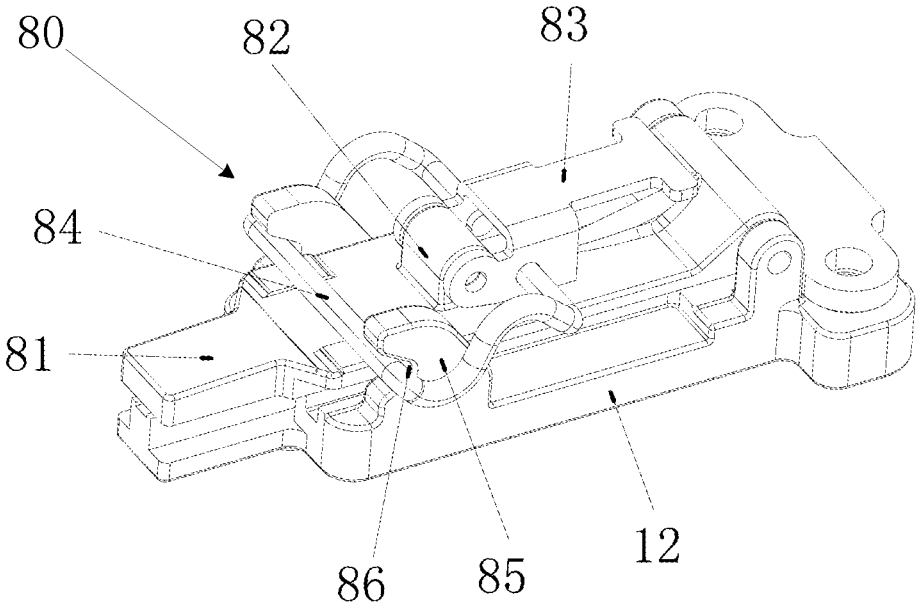
FIG. 6 shows a perspective view of a muzzle assembly used in a nail gun according to one embodiment of the invention.
Figure 7:
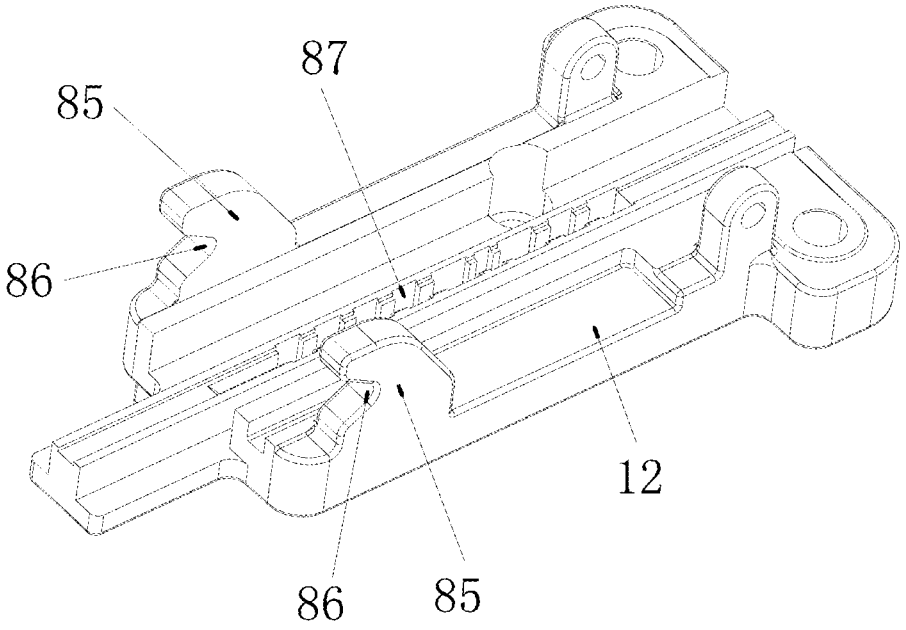
FIG. 7 shows a perspective view of a muzzle used in a nail gun according to one embodiment of the invention.

As shown in FIGS. 2 and 6-7, a muzzle assembly 80 is shown according to embodiments of the invention. The muzzle 12 is hinged with a cover plate 81. The cover plate 81 and the muzzle 12 form a region therebetween for the movement of the nail striking member 32. A mounting hole 87 for mounting the nail magazine assembly 15 is provided in the middle of the muzzle 12 in a slot form, such that the nails in the nail magazine assembly 15 can be operably pushed out from the mounting hole 87, which are operably punched out from the muzzle 12 to a nailing position of interest by the nail striking member 32, particularly by the front end 322 of the nail striking member 32. The cover 81 is provided with a locking assembly. The locking assembly includes a mounting seat 82 formed on the cover 81, a flip cover 83 hinged on the mounting base 82, a fixing buckle 84 hinged on the flip cover 83, and a locking block 85 formed on the muzzle 12. The locking block 85 is provided with a groove 86 on which the fixing buckle 84 is received. When the flip cover 83 is pulled upward, the fixing buckle 84 rotates with the flip cover 83, and is disengaged from the slot 86, thereby releasing the front end connection of the cover plate 81 to the muzzle 12. As such, the cover plate 81 can rotate around the hinge at the rear end of the cover plate 81 to open the muzzle 12 and check the nails therein.

Referring to FIGS. 1-3 and 13-18, various embodiments of the energy storage mechanism/device 10 are disclosed, which are used for a nail gun with a driving mechanism 30 having a piston 61 and a nail striking member 32 co-movably connected to the piston 61, and a driving member 34 being operably alternatively engaged and disengaged with the nail striking member 32.

In one embodiment, the energy storage mechanism/device 10 includes a cylinder 11 having a front end cover 111 and a rear end cover 112. The piston 61 is disposed in the cylinder 11 such that the nail striking member 32 operably move backward and forward through the front end cover 111 of the cylinder 11 in a straight line. The energy storage mechanism 10 also includes at least one spring 71 disposed in the cylinder 11 for store energy and release/discharge the store energy therein. The at least one spring 71 is configured such that an engagement of the driving member 34 with the nail striking member 32 causes the piston 61 to move backward in the cylinder 11 to push the at least one spring 71 into a contract state so as to store energy therein, and an disengagement of the driving member 34 with the nail striking member 32 causes the least one spring 71 to release the stored energy therein to push the piston 61 to move frontward in the cylinder 11 so that the nail striking member 32 is co-moved therewith to strike a nail out of a muzzle 12.

The at least one spring 71 can be at least one mechanical spring, or a gas spring. The mechanical spring relies on elastic deformations to store or discharge/release energy. The gas spring uses compressed gas contained within an enclosed cylinder sealed by a sliding piston to pneumatically store potential energy and withstand external force applied parallel to the direction of the piston shaft.

Figure 13:
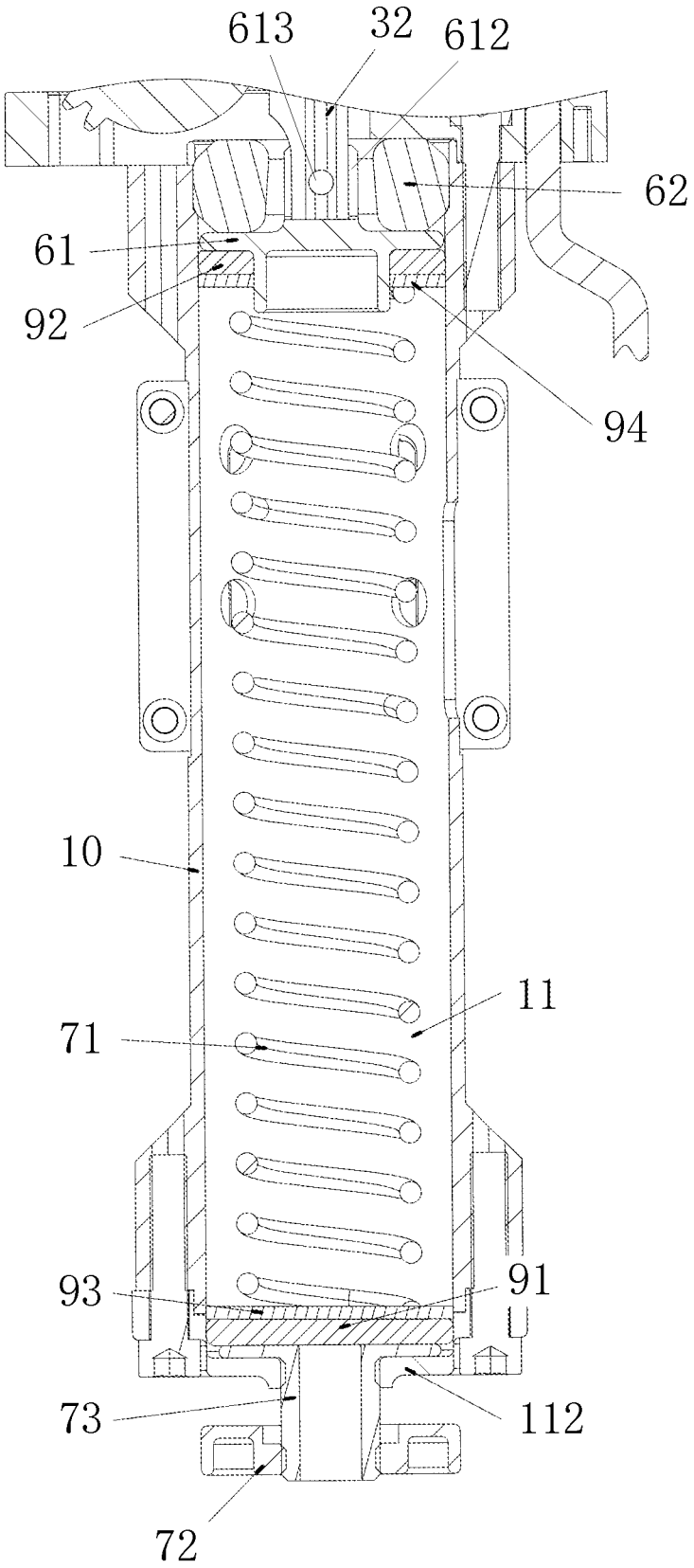
FIG. 13 shows a cross-sectional view of an energy storage mechanism used in a nail gun according to one embodiment of the invention.

In some embodiments as shown in FIGS. 3 and 13-14, the at least one spring 71 comprises one spring 71.

Figure 15:
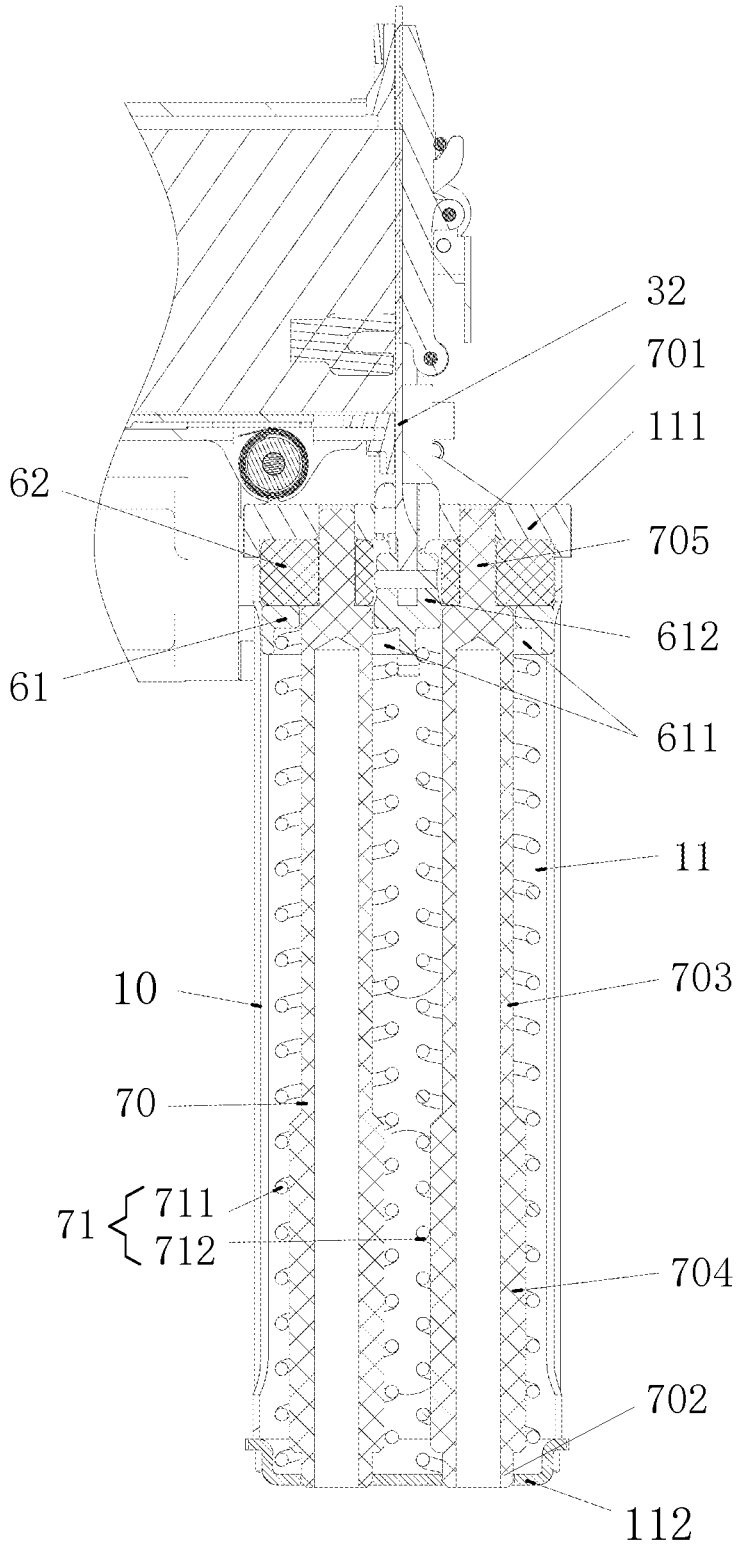
FIG. 15 shows a cross-sectional view of a nail gun according to one embodiment of the invention.
Figure 16:
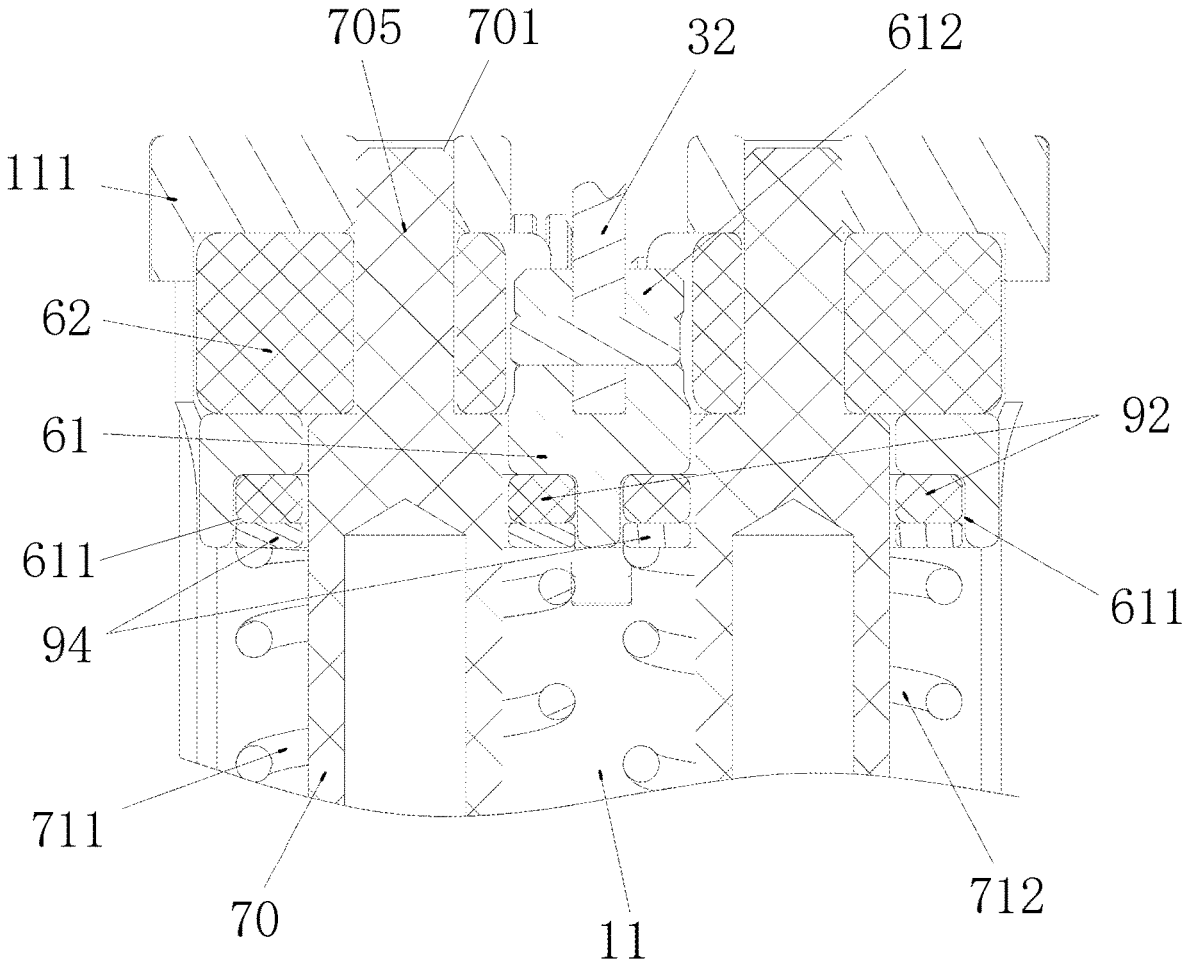
FIG. 16 shows a partially cross-sectional view of a nail gun according to one embodiment of the invention.
Figure 17:
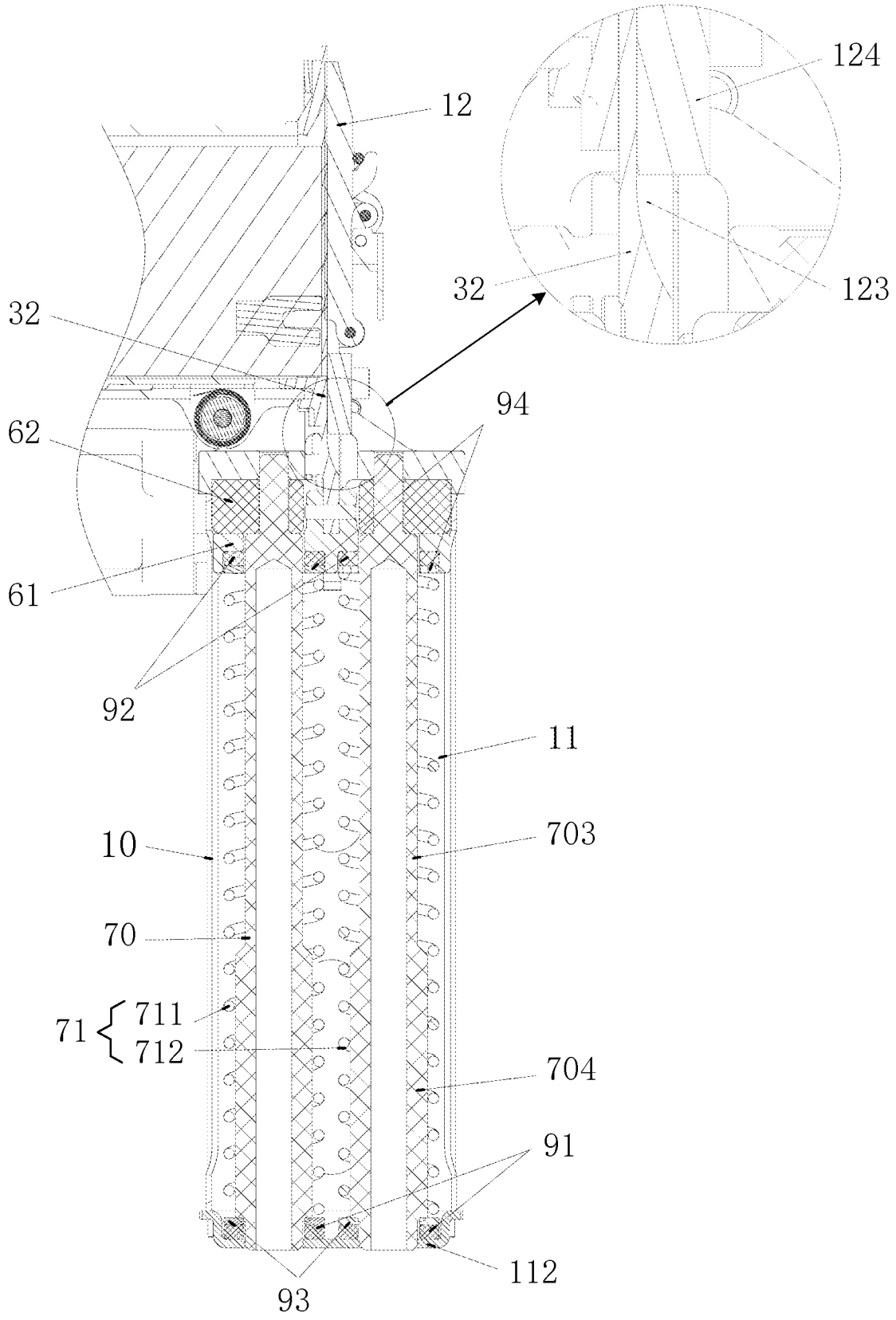
FIG. 17 shows a cross-sectional view of a nail gun according to one embodiment of the invention.

In other embodiments as shown in FIGS. 15-17, the at least one spring 71 comprises two springs 711 and 712 disposed in the cylinder 11. The helical directions of springs 711 and 712 are aligned oppositely with one another.

In certain embodiments, the at least one spring comprises more than two springs disposed in the cylinder 11 and configured such that helical directions of two adjacent springs are aligned oppositely with one another. In some embodiments, even number of springs are preferably used.

The energy storage mechanism 10 may further include at least one guiding rod 70. Each guiding rod 70 has a front end 701 and a rear end 702 and is received in a respective one of the at least one spring 71 such that the front end 701 and the rear end 702 of each guiding rod 70 are respectively in contact with the front end cover 111 and the rear end cover 112 of the cylinder 11, as shown in FIGS. 15 and 17. Each guiding rod 70 has a first guiding portion 703 proximal to the front end 701 and a second guiding portion 704 backward extending from the first guiding portion 703, wherein a diameter of the first guiding portion 703 is less than that of the second guiding portion 704.

In addition, the energy storage mechanism 10 may include an adjusting member having a cap 72 and an adjustment screw 73 extending from the cap 72 into in the cylinder 11 through the rear end cover 112 and being in contact with the at least one spring 71 for adjusting tightness of the spring 71 in the cylinder 11, as shown in FIGS. 1-3 and 13.

The energy storage mechanism 10 also includes a shock absorbing mechanism to operably reduce shocks generated between the piston 61 and the cylinder 11. In one embodiment, the shock absorbing mechanism includes a buffer block 62 disposed in the cylinder 11 between a front end cover 111 of the cylinder 11 and the piston 61, as shown in FIGS. 3, 12 and 14-17.

In another embodiment, the shock absorbing mechanism further includes a front shock absorbing cushion 92 and a front gasket 94 disposed between the piston 61 and the at least one spring 71, as shown in FIGS. 13-14 and 16-17.

In certain embodiments, the shock absorbing mechanism also includes a rear shock absorbing cushion 91 and a rear gasket 93 disposed between the at least one spring 71 and the rear end cover 112 of the cylinder 11, as shown in FIGS. 13-14 and 17.

In some embodiments, as disclosed above and shown in FIGS. 3 and 13-14, the energy storage device 10 includes a single spring 71 disposed in the cylinder 11 and connected to the nail striking member 32 through the piston 61 such that when the driving member 34 drives the nail striking member 32 to move inward, the spring 71 is compressed. When the driving member 34 rotates to the area without teeth (non-tooth portion) 341, the nail striking member 32 is released and the nail striking member 32 reaches the maximum stroke. Because there is no engagement of the driving member 34 with the nail striking member 32, the nail striking member 32 is ejected under the elastic force of the spring 71 to complete the nailing process. In some embodiments, the buffer block 62 is used to protect the driving spring 71 and the nail striking member 32.

In addition, an adjustment component is provided on the rear end of the spring 71 for adjusting the tightness of the spring 71 in the cylinder 11. The adjustment component includes an adjusting cap 72 and an adjusting screw 73 extending from the adjusting cap 72 and disposed against the rear end of the spring 71. By turning the adjustment cap 72, the adjustment screw 73 is driven to move in the cylinder 11, thereby adjusting the tightness of the spring 71. The tighter the spring 7 is installed, the greater the spring force it generates, which can be very conveniently adjusted based on actual conditions.

As shown in FIGS. 15-17, two springs 711 and 712 are disposed side by side in the cylinder 11, such that the spiral/helical directions of two adjacent springs 711 and 712 are opposite. The two springs 711 and 712 are disposed between the rear end cover 112 and the piston 61 in the cylinder 11, the piston 61 in turn connects the nail striking member 32. The piston 61 has a mounting post 612 formed in the middle of the piston 61 for connecting to the nail striking member 32. For the side-by-side arrangement of the two springs 711 and 712, the forces of the two springs 711 and 712 can be operably superimposed and converted into a force that finally pushes the nail striking member 32. In addition, because the spiral directions of two adjacent springs 711 and 712 are opposite, the resonance frequencies of the two springs 711 and 712 are offset, which prevents the springs 711 and 712 from resonating during the vibration process and eliminates the harmful effects of resonance on the nail gun. It should be appreciated that three or more springs can also be utilized to practice the invention.

The buffer block 62 is placed between the front end cover 111 of the cylinder 11 and the piston 61 such that the outer end surface of the piston 61 is in contact with the inner end surface of the buffer block 62. The buffer block 62 acts as a buffer for the entire energy storage mechanism 10 in the main body 101.

Further, the guide rod 70 is placed in each of the energy storage springs 711 and 712 houses. The front end of the guide rod 70 penetrates the piston 61 and is disposed in the main body 101, and the rear end of the guide rod 70 is disposed at the rear end cover 112 of the cylinder 11. In some embodiments, the guide rod 70 includes a first-level guide segment 701 and a second-level guide segment 702. The outer diameter of the first-level guide segment 701 is smaller than the outer diameter of the second-level guide segment 702. The segmented arrangement of the guide rod 70 can not only save materials, but also play a role in guiding unity.

As shown in FIG. 16, each guide rod 70 has a mounting post 705 at the front end 701. The piston 61 has mounting grooves 611 each groove corresponding to a respective guide rod 70. Each mounting groove 611 has a through hole in the middle, and the buffer block 62 has mounting holes each coaxially aligned with a respective through hole. Each mounting post 705 is inserted into the front end cover 111 through the respective through hole and the respective mounting hole. Two mounting posts 705 are inserted into the front end cover 111 to form two guide action points. In addition, as shown in FIG. 17, the nail striking member 32 is provided with a guide groove 123, and a guide piece 124 provided in the guide groove 123 and located in the extension line of the middle of the two guide rods 70, which forms a third guide action point on the top. The three guide action points operably guide the two springs 711 and 712 and the piston 61, respectively. Because the guide rod 70 is directly installed through the piston 61, the guiding functions of the three guide action points are unified, so that the resulting thrust is superimposed on the central part of the piston 61 to uniformly apply force to the nail striking member 32. Such configuration allows two guide rods 70 to be uniformly attached on one piston 61, so that during the movement, the multiple springs 711 and 712 always maintain a unified and synchronized movement, with uniform force and uniform direction of actions.

The rear end cover 112 is integrated with the main body 101 or separately mounted on the main body 101. When separated, the rear end cover 112 can be fixed on the main body 101 by screws, or directly threaded or buckled to the main body 101. When integrated, a spring seat can be provided inside the rear end cover 112 to assist in installing the springs 701 and 702.

In certain embodiments, as shown in FIG. 17, rear shock-absorbing pads 91 are disposed between the rear end cover 112 and the springs 711 and 712; and front shock-absorbing pads 92 are disposed between the piston 61 and the springs 711 and 712. The nail striking member 32 is connected to the piston 61 by a fixing member such as a pin 613 (FIG. 14). In operation, the driving member 34 drives the nail striking member 32 to move, which in turn drives the piston 61 to move in the cylinder 11. Meantime, under the action of the piston 61, the springs 711 and 712 is compressed to the contract state to store energy therein. When the driving member 34 disengages with the nail striking member 32, the piston 61 moves to the limit position, then the springs 711 and 712 expend to the expand state to release the stored energy, thereby driving the nail striking member 32 to complete the nailing process. The energy storage springs 711 and 712 are likely to jump due to the large elastic force immediately after returning. The use of the front shock absorbing pads 92 and the rear shock absorbing pads 91 can alleviate the springs 711 and 712 jumping, making the springs 711 and 712 are cushioned to achieve shock absorption, extend the life span of the springs 711 and 712, and avoid the situation where the outer end of the nail is distorted by the jump of the main body 101 when the nailing is completed.

The material of the front shock-absorbing pads 92 and the rear shock-absorbing pads 91 are soft materials, preferably polyurethane. Polyurethane possesses a thermoplastic linear structure. Compared to PVC foam materials, polyurethane has better stability, better chemical resistance, better resilience and mechanical properties, less compression deformation, and good thermal insulation, sound insulation, shock resistance. The properties of polyurethane are between plastic and rubber, while polyurethane is oil resistant, wearing resistant, low temperature resistant and aging resistant with high hardness and elasticity. Other elastic materials can also utilized to practice the invention.

The spring force of the spring 711 and 712 is usually very large during operation, and its impact on the shock absorbing pads 91 and 92 is also very large. In certain embodiment, to avoid the shock absorbing pad wearing from the springs during long-term use, a rear gasket 93 and a front gasket 94 are disposed between the rear cushion 91 and the springs 711 and 712, and between the front cushion 92 and the springs 711 and 712, respectively. That is, the two ends of each spring 711/712 are placed on the front gasket 94 and the rear gasket 93, respectively, which improves the wear resistance of the structure and prolongs the life span of the nail gun. The front gasket 94 and the rear gasket 93 can be metal gaskets, or the likes. Although the springs are in contact with the metal gaskets, they also realize the function of cushioning and shock absorption due to the shock-absorbing cushions.

Specifically, as shown in FIG. 16, two mounting grooves 611 are arranged in parallel on the piston 61, and the through hole is provided in each mounting groove 611, and the buffer block 62 is disposed in a corresponding mounting hole. The guide rod 70 has a mounting post 705 at the front end, the mounting post 705 penetrates the through hole and the mounting hole and places in the main body 101. The side wall of the mounting groove 611 and the outer surface of the guide rod 70 define a mounting space therebetween for receiving the front gasket 94 and the front shock absorbing pad 92. The front ends of the two springs 711 and 712 are respectively placed against the front gaskets 94 located in the mounting grooves 611 on both sides.

In some embodiments, the energy storage device 10 is a gas spring assembly. Specifically, the gas spring assembly includes a guide cylinder 11 in which a working air chamber is defined. The piston 61 is connected to the inner end of the nail striking member 32, and the outer side wall of the piston 61 is in contact with the inner wall of the working air chamber. An air storage chamber is provided on one side of the guide cylinder, and an air intake chamber is in fluidic communication with the air storage chamber. When the nail striking member 32 moves in the working air chamber under the driving of the driving member 34, the volume in the working air chamber becomes smaller, so that the pressure of the working air in the working air chamber gradually increases. When the driving member 34 no longer drives the nail striking member 32 to move, the nail striking member 32 is pushed out under the action of the compressed gas in the working air chamber to complete the nailing process. In addition, a pressure relief valve is connected to the air reservoir.

In some embodiments, the drive control and protection mechanism/device 20 is adapted to automatically break the circuit after nailing, thereby enhancing the safety of the nail gun.

As shown in FIGS. 1-2 and 8-11, one embodiment of the drive control and protection device 20 includes a switch bracket 21 and a drive rod 22 provided on the main body 101. The drive control/protection device 20 also includes a toggle switch 23 mounted on the switch bracket 21. The toggle switch 23 includes a toggle block 231 for controlling the toggle switch 23 to be turned on or turned off, and an L-shaped paddle 24 rotatably attached to the switch bracket 21. The ends of the two right-angle sides of the L-shaped paddle 24 are respectively a triggered end 241 and a toggle end 242. The intersection of the two right-angle sides of the L-shaped paddle 24 is connected to the switch bracket 21 through the latch 243 so that the triggered end 241 and the toggle end 242 are rotatable around the latch 243. As assembled, the trigger end 241 extends into a slot 14 formed on the main body 101 and the toggle end 242 is located on the side of the toggle block 231.

The drive control and protection device 20 further include an actuating member 25 coupling with the front end of the driving rod 22 and extending to the front end of the main body 101. The driving rod 22 includes a toggle contact 221 facing the toggle block 231. When the nail gun is in operation, the main body 101 is pressed against the nailing position and the actuating member 25 touches the nailing panel, which drives the driving rod 22 to move backward. During the moving process, the toggle contact 221 on the driving rod 22 touches the toggle block 231 and pushes the toggle block 231 to move, so as to turn on the toggle switch 23 and connect the power supply for nailing.

The piston 61 disposed in the cylinder 11 in the main body 101 operably generates a pushing force on the trigger end 241 that extends into the slot 14 during the movement of triggering nailing. When the trigger end 241 is pushed, it causes the toggle end 242 to move and push the toggle block 231 moves, which prompts the toggle switch 23 to be turned off and disconnects the power, so as to protect the user from being harm during operation, thereby improving the safety.

Figure 8:
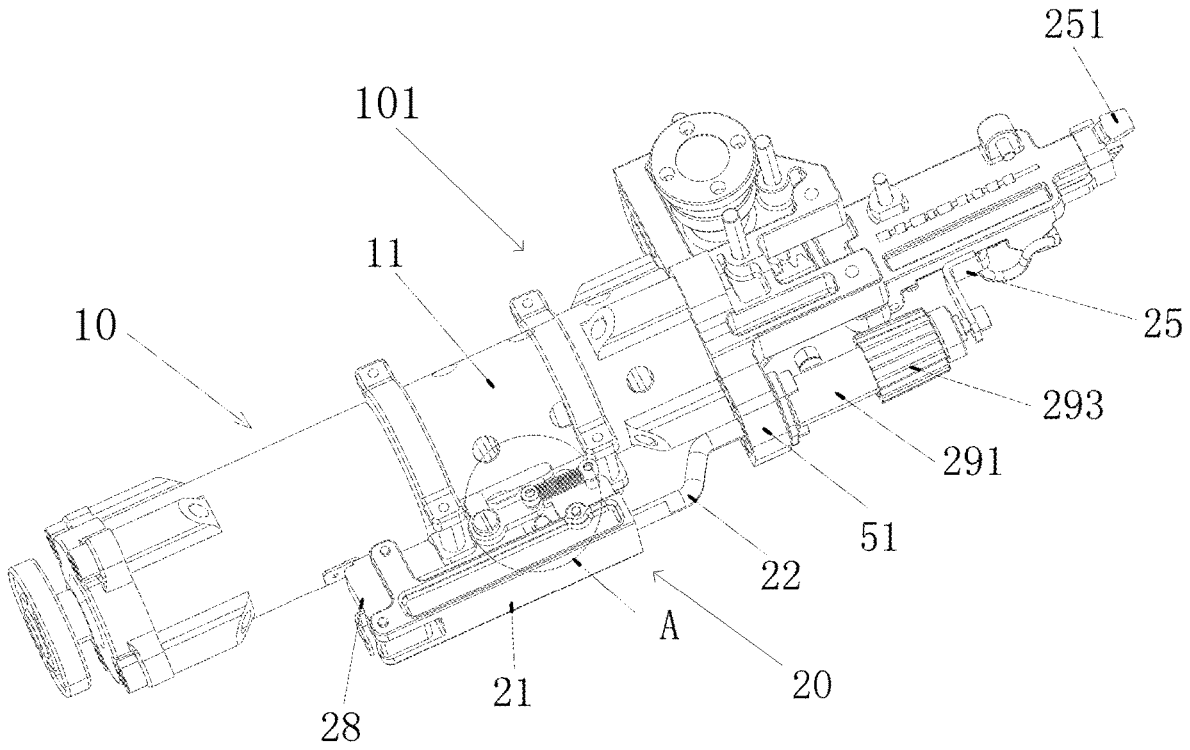
FIG. 8 shows a perspective view of a nail gun according to one embodiment of the invention.
Figure 9:
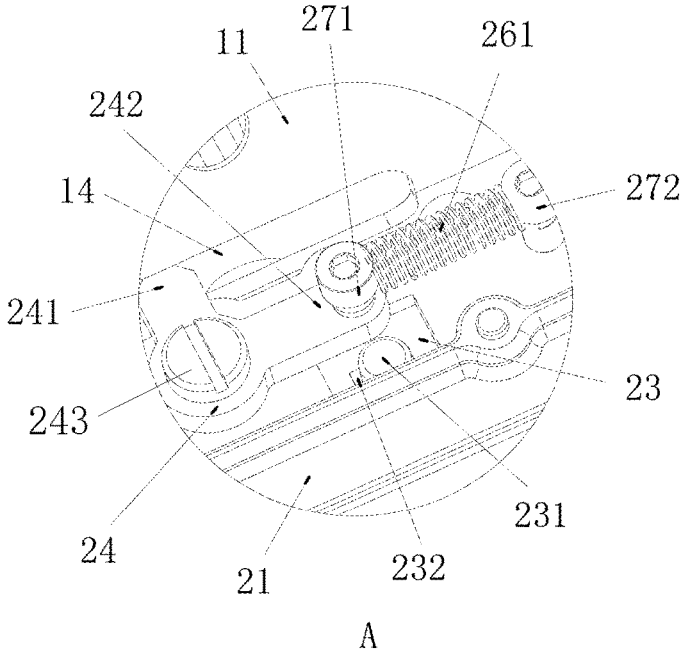
FIG. 9 shows an enlarged view of a portion A of the nail gun shown in FIG. 8.
Figure 11:
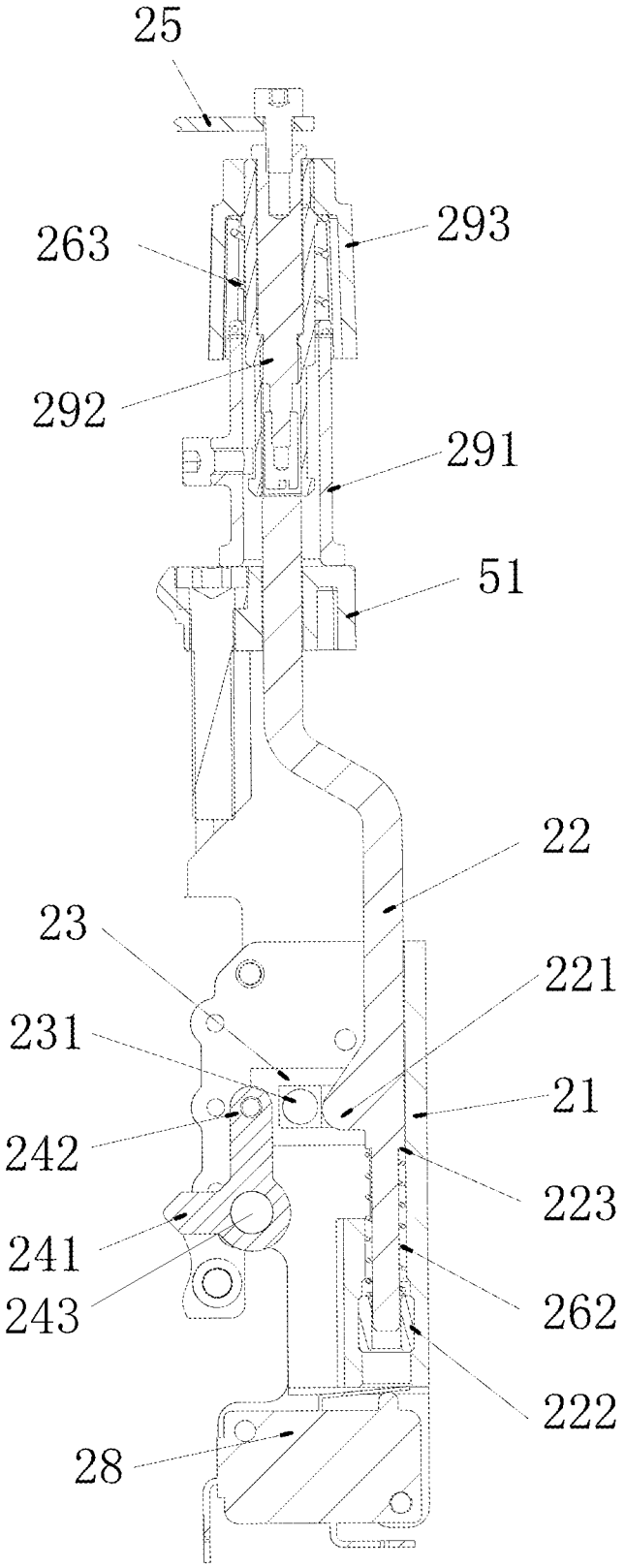
FIG. 11 shows a cross-sectional view of the drive control and protection mechanism/device shown in FIG. 10.

The toggle switch 23 has a sliding slot 232 defined thereon, which the toggle block 231 is movably disposed in the sliding slot 232, as shown in FIGS. 8-9 and 11. The toggle contact 221 and the toggle end 242 of the L-shaped paddle 24 are respectively located on two opposite, lateral sides of the toggle block 231. Accordingly, when the toggle contact 221 or the toggle end 242 touches the toggle block 231, it drives the toggle block 231 to move in the sliding slot 232. Such movement of the toggle block 231 in the sliding slot 232 results in the toggle switch 23 to be turned on or turned off.

As shown in FIGS. 8-9 and 11, a tension spring 261 is provided between the toggle end 242 and the switch bracket 21, and has its two end buckled on a first pin 271 provided on the toggle end 242 and a second pin 272 provided on the switch bracket 21, respectively. Such configuration of the tension spring 261 operably enables the return of the L-shaped paddle 24.

Figure 10:
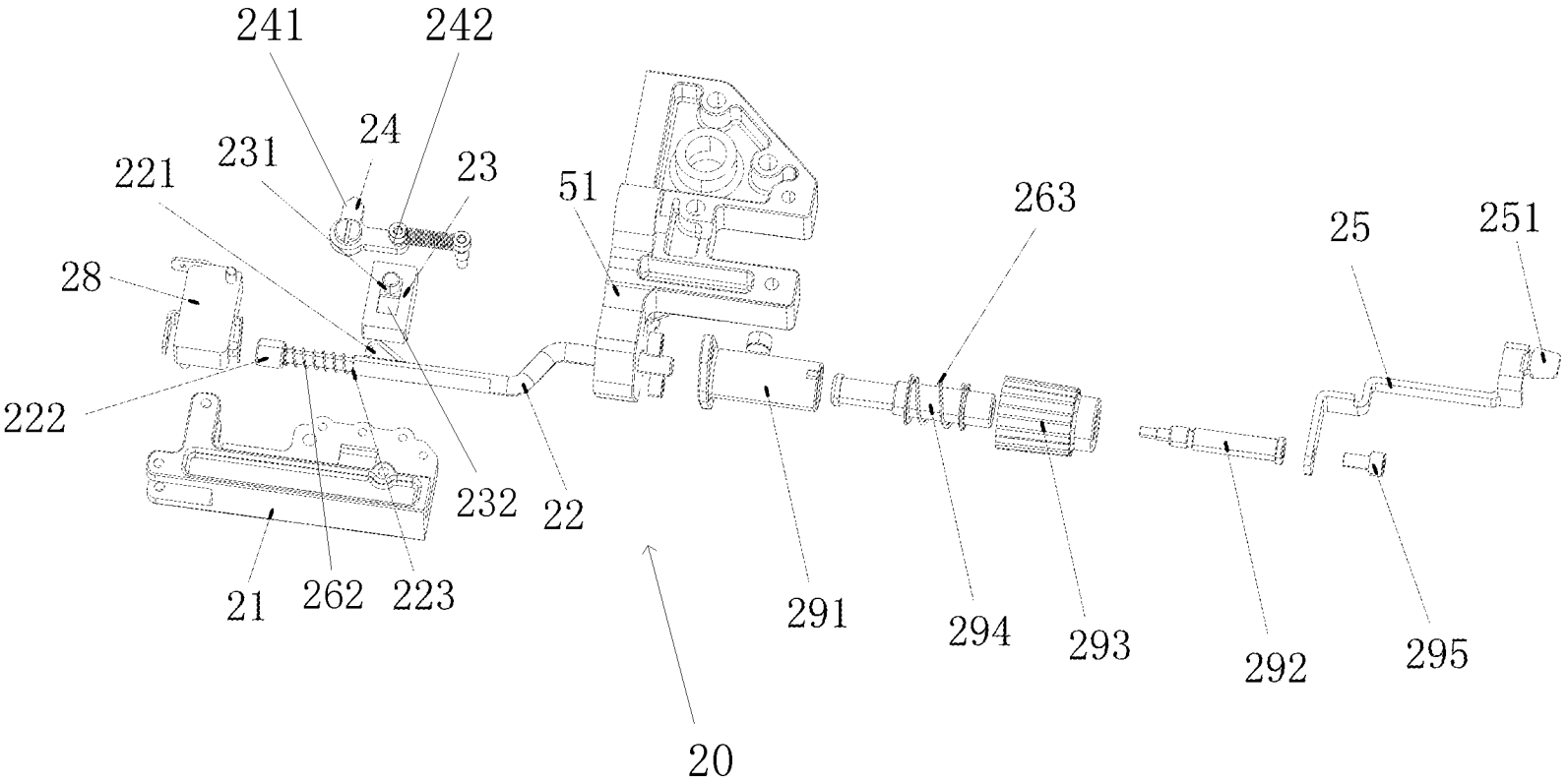
FIG. 10 shows an exploded view of a drive control and protection mechanism/device used in a nail gun according to one embodiment of the invention.

The switch bracket 21 further includes a switch 28 for sensing micro movements. The drive rod 22 has a micro-motion contact 222 integrally with or separately formed on the rear end facing the micro-motion switch 28, a stop 223 formed on the drive rod 22, and a first return spring 262 is disposed between the micro-motion contact 222 and the stop 223 and pressed against the micro-motion contact 222, as shown in FIG. 10. The micro-motion switch 28 is a trigger switch. When the driving rod 22 moves toward the micro-motion switch 28 during the nailing process and causes the micro-motion contact 222 to touch the micro-motion switch 28, the micro-motion switch 28 is turned on, i.e., the power on, and keeps in the turned-on state until the nailing is completed. After the main body 101 is left from the nailing panel when the nailing is completed, the driving rod 22 is reset under the action of the first return spring 262, and the micro-motion contact 222 is moved away from the micro-motion switch 28, thereby turning off the power supply of the nail gun.

Still referring to FIG. 10, the main body 101 also includes the connection member 51. The front end of the driving rod 22 passes through the connection member 51 and is connected to the actuating member 25 through a connecting assembly. The connecting assembly includes a fixed sleeve 291 connected to the connection member 51, an adjusting rod 292 disposed in the fixed sleeve 291, a tightening sleeve 293 rotatably connected to the fixed sleeve 291 and setting on the outer side of the adjusting rod 292, a fixing tube 294 disposed between the adjusting rod 292 and the tightening sleeve 293, and a second return spring 263 sleeved on the outer side of the fixing tube 294, as shown in FIGS. 10-11. The outer end of the adjusting rod 292 is connected to the actuating member 25 through a screw 295. The tightness of the connecting assembly is adjusted by rotating the tightening sleeve 293. The adjusting rod 292 is arranged coaxially with the driving rod 22. When the actuating member 25 drives the adjusting rod 292 to move backward, the adjusting rod 292 pushes the driving rod 22 accordingly.

As shown in FIGS. 1-2 and 10, particularly in FIG. 10, the front end of the actuating member 25 is provided with the pressing piece 251. The outer end of the pressing piece 251 extends out of the muzzle 12 that is disposed in the front end of the main body 101. When the main body 101 is pointed to the nailing position, the pressing piece 251 first touches the nailing position. While the user applies force to the main body 101 during nailing, the nailing position generates a reaction force on the pressing piece 251 to push the actuating member 25 backward, which causes the power to be turned on by the micro-motion switch 28 until the nailing is completed.

Referring FIGS. 18-20 now, one embodiment of the nail gun includes a main body 101 with a switch assembly on the main body 101. The switch assembly includes a first micro-motion switch 523, a second micro-motion switch 528 and a switch for controlling the motor. The nail gun starts to operate only when all the three switches are turned on at the same time.

Similarly, as shown in FIG. 18, the main body 101 include a cylinder 11 having a rear end cover 112, and a piston 61 movably disposed in the cylinder 11, and an energy storage spring 71 disposed in the cylinder 11 between the piston 61 and the rear end cover 112. The energy storage spring 71 can be directly connected to the piston 61 and the rear end cover 112, or cushions and gaskets are disposed between the energy storage spring 71 and the piston 61, and/or between the energy storage spring 71 and the rear end cover 112 so as to enhance the shock absorption during operation. A guide rod 70 is placed inside the energy storage spring 71 with one end 702 connecting to the rear end cover 112 and the other end 701 connecting to the front end of the main body 101 through the piston 61. The guide rod 70 includes a first guiding portion 702 and a second guiding portion 704 extending from the first guiding portion 702 to the rear end cover 112. The piston 61 is connected with a nailing member 32 and is movable on the first guiding portion 703. In use, when all the three switches are turned on, i.e., all in the closed state, the nail striking member 32 together with the piston 61 moves on the first guiding portion 703 under driving of the motor, so that the energy storage spring 71 is compressed. When the piston 61 moves to around the junction between the first guiding portion 703 and the second guiding portion 704, the piston 61 reaches the maximum stroke, at this time the motor drive stops, and then the energy storage spring 71 pushes out the piston 61 is under the elastic force, so that the nail striking member 32 is driven out to perform the nailing process.

As shown in FIGS. 18-20, the control and protection mechanism is adapted for controlling open (turned-off) and close (turned-on) states of the first micro-motion switch 523 and the second micro-motion switch 528. In the embodiment, the first micro-motion switch 523 is a normally closed switch, while the second micro-motion switch 528 is a normally open switch. The control and protection mechanism includes a driving rod 522, a lock pin 526, a switch bracket 521, a toggle block 524, a drive spring 552, and a reset element 551, an actuating member 25, and the switch assembly.

The lock pin 526 is set on the driving rod 522 or the main body 101 through the drive spring 552. The lock pin 526 is movably disposed on the switch bracket 521 that is in turn disposed on the main body 101. The toggle block 524 is rotatably attached to the switch bracket 521, while the first micro-motion switch 523 and the second micro-motion switch 528 are fixed on the switch bracket 521. The toggle block 524 includes a toggle end 5242 and a trigger end 5241. The trigger end 5241 extends into inside the main body 101 through a slot 14 formed in the side wall of the cylinder 11 at a location proximate to the junction of the first guiding portion 703 and the second guiding portion 704, such that when the piston 61 is moving in the first guiding portion 703 and pushes the trigger end 5241. The push to the trigger end 5241 causes the toggle block 524 to rotate and therefore the toggle end 5242 to move, which causes the first micro-motion switch 523 (normally closed switch) to be opened/disconnected by a trigger circuit. As such, it will automatically be opened/disconnected during nailing. Disconnecting the power during nailing can avoid the situation of continuous nailing at the same position. The triggering of the first micro-motion switch 523 in this embodiment does not require manual operation and can be achieved directly by the movement of the piston 61, which is very convenient. Conventionally, Hall element or a photosensitive switch is used to automatically disconnect the circuit. However, the mechanical structure of the switching mechanism adopted in this embodiment is not affected by the environment, and is much more stable and reliable, and has longer life span.

The slot 14 is formed on the side wall of the cylinder 11 near the junction of the first guiding portion 703 and the second guiding portion 704. When the piston 61 reaches the junction, it reaches the maximum stroke position. Due to the elastic reaction of the energy storage spring 71, the more the piston 61 moves backward, the slower the speed will be. When piston 61 moves to the junction, the speed of the piston 61 will almost drop to 0. Thus, the trigger end 5241 of the toggle block 524 is touched during the gradual speed reduction, which can avoid the damage caused by too fast and violent collision between the trigger end 5241 and the piston 61, thereby extending the service life of the nail gun.

In order to keep the first micro-motion switch 523 in the open state after the toggle block 524 is pushed by the piston 61, a lock groove 527 is formed on the toggle block 524, and the lock pin 526 is received in the lock groove 527 to prevent the toggle block 524 from rotating. In a normal position, the end of the lock pin 626 abuts on the circumference of the toggle block 524. When the toggle block 524 rotates after being thrust by the piston 61, the lock groove 527 gradually turns to the direction of the lock pin 526, and the lock pin 526 extends into the lock groove 527 under the drive of the drive spring 552, as shown in FIG. 19. Under the locking of the lock pin 526, the toggle block 524 cannot be rotated to reset, so that the first micro-motion switch 523 continues to remain in the open and disconnected state.

The actuating member 25 is coupled to the front end of the driving rod 522 and extends into the front end of the main body 101. The reset element is coupled to the driving rod 522 for driving the driving rod 522 and the actuating member 25 to reset (return). In one embodiment, the reset element is a reset spring 551. A pressing piece 251 is provided at the front end of the actuating member 25 such that the outer end of the pressing piece 251 extends out of the muzzle 12. When the nail gun is pressed against a nailing position, the actuating member 25 first contacts the nailing position, and then drives the driving rod 522 under the reaction force to move backward, so that the muzzle 12 contacts the nailing position. When the nail striking/shooting is completed and the nail gun lifts from the nailing position, the actuating member 25 and the driving rod 522 move forward to reset driven by the elastic force of the return spring 551.

The second micro-motion switch 528 is attached to the switch bracket 521. The driving rod 522 is provided with a micro-motion contact 5222 facing the second micro-motion switch 528. When the pressing piece 251 is pressed against the nailing position during operation, the driving rod 522 is moved backward by the thrust of the actuating member 25, then the micro-motion contact 5222 acts on the second micro-motion switch 528 (normally open switch) to trigger the second micro-motion switch 528 to be closed, thereby turning the circuit on.

The driving rod 522 is provided with a sliding groove 5221 at one end proximate to the micro-motion contact 5222. A push block 5261 is formed at one end of the lock pin 526. The outer end of the push block 5261 extends out of the sliding groove 5221, and the main body 101 provided with a fixed bracket 554, the return spring 551 is disposed between the fixed bracket 554 and the driving rod 522, the drive spring 552 is disposed between the lock pin 526 and the fixed bracket 554. The maximum spring force that the return spring 551 can achieve is greater than the maximum spring force that the drive spring 552 can achieve. When the nail gun lifts off the nailing position, the driving rod 522 and the actuating member 25 are pushed to reset under the elastic force of the return spring 551, the driving rod 522 moves forward, and the micro-motion contact 5222 leaves the second micro-motion switch 528. The second micro-motion switch 528 is restored to the open state. Meanwhile, as the push block 5261 extends into the sliding groove 5221 during the forward movement of the drive rod 522, the end side of the sliding groove 5221 gradually sticks to the push block 5261 because the maximum elastic force of the return spring 551 is greater than the maximum elastic force of the drive spring 552, so that the driving rod 522 can drive the push block 5261 to move forward. That is, the lock pin 526 is driven by the driving rod 522 to move forward and gradually separate from the lock groove 527, the toggle block 524 is rotated and reset under the reaction force of the first micro-motion switch 523, and the first micro-motion switch 523 returns to the closed state. In this state, since the second micro-motion switch 528 is open and the first micro-motion switch 523 is closed, the nail gun cannot be activated even if the motor switch is pressed, which avoids the situation that the nail gun can still be opened after the nail shooting is completed, thereby enhancing the safety.

The front end of the driving rod 522 is connected to the actuating member 25 through an adjustment component, as shown in FIG. 20, the adjustment component includes an adjustment screw 561 and an adjustment nut 562. The driving rod 522 is connected to the adjusting nut 562, and the actuating member 25 is connected to the adjusting screw 561. The adjusting component can adjust the distance between the driving rod 522 and the actuating member 25 according to actual operating conditions, which is very convenient.

When the nail gun is not used (initial state), the first micro-motion switch 523 is a normally closed switch and remains closed, and the toggle block 524 is also in the original position (i.e., the lock pin 526 is on the circumference of the toggle block 524). Since the second micro-motion switch 528 is a normally open switch, the circuit cannot be turned on, and nailing cannot be achieved even if the motor switch is pressed (turned on).

When the nail gun is used to nail a nail on the nailing position, the front end of the nail gun is pressed against the nailing position, the actuating member 25 first contacts the nailing position, and then the actuating member 25 drives the driving rod 522 to move backward under the reaction force, which makes the muzzle 12 contact the nailing position. Meantime, during the backward movement of the driving rod 522, the micro-motion contact 5222 acts on the second micro-switch 528 (normally open switch) to trigger the second micro-motion switch 528 to be closed. At this moment, the first micro-motion switch 523 and the second micro-motion switch 528 are both in the closed state, and the nail gun can be started by pressing and turning-on the motor switch. After the motor is started, the nail striking member 32 pushes the piston 61 under the control of the motor to move on the first guiding portion 703. When the piston 61 quickly moves to the junction position, the trigger end 5241 of the toggle block 524 is rotated by the thrust of the piston 61, prompting the toggle end 5242 to trigger the first micro-motion switch 523 to disconnect the circuit, and at the same time, the lock groove 527 turns toward the direction of the lock pin 526, the lock pin 526 is inserted into the lock groove 527 to prevent the toggle block 524 from rotating and resetting, so that the first micro-motion switch 523 is continuously kept off. The nail striking member 32 also loses the driving force from the motor at this point. Under the elastic force of the energy storage spring 71, the piston 61 is pushed out with the nail striking member 32 to achieve nailing. Since the first micro-motion switch 523 is continuously kept in the off state, the circuit cannot be restarted after the nail is shot, which avoids the situation of repeating the nail, thereby improving the safety.

When the nail gun is removed from the nailing position after the nailing is completed, under the elastic force of the return spring 551, the driving rod 522 and the actuating member 25 are pushed to reset, and the driving rod 522 moves forward. The micro-motion contact 5222 leaves the second micro-motion switch 528, so that the second micro-motion switch 528 is restored to the disconnected state. Meanwhile, during the forward movement of the driving rod 522, the side of the end of the sliding groove 5221 gradually sticks on the push block 5261, since the maximum elastic force of the return spring 551 is greater than that of the drive spring 552, the drive rod 522 can drive the push block 5261 to move forward, that is, the lock pin 526 is driven by the driving rod 522 to move forward and gradually move out of the lock groove 527, and the toggle block 524 rotates and resets under the reaction force of the first micro-motion switch 523. At this time, the first micro-motion switch 523 returns to the closed state, i.e., the initial state. In this state, the nail gun cannot be started even if the motor switch is pressed since the second micro-motion switch 528 is opened and the first micro-motion switch 523 is closed, which avoids the situation of which the nail gun can still be opened after the nailing is completed, which enhances the safety.

Briefly, the invention discloses, among other things, a nail gun including an energy storage device/mechanism having one or more springs. In operation, the one or more springs generate thrust on the nailing member and push it out and reset it when the nailing process completes. In addition, the nail gun also includes a protection device such that after the nailing is completed, the protection device automatically turns the power off, thereby improving the safety.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

What is claimed is:

1. A control and protection mechanism used for a nail gun having a main body having an energy storage mechanism including a cylinder, and a striking mechanism having a piston disposed in the cylinder and a nail striking member co-movably connected to the piston, comprising:

a first micro-motion switch, a second micro-motion switch, a switch bracket, a toggle block, a lock pin, an actuating member, a micro-motion contact and a driving rod, wherein the switch bracket is attached to the main body;

the first micro-motion switch and the second micro-motion switch are fixed on the switch bracket;

the toggle block is rotatably attached to the switch bracket, and includes a lock groove, a trigger end and a toggle end, wherein the toggle end is operably coupled to the first micro-motion switch and the trigger end extends into inside the main body such that when the piston moves in the cylinder to a position, the piston pushes the trigger end to prompt the toggle block to rotate and therefore the toggle end to move, thereby causing the first micro-motion switch to change its switch state;

the lock pin is movably attached to the switch bracket and operably extends into the lock groove to prevent the toggle block from rotating;

the actuating member is attached to a front end of the driving rod and extends to a front end of the main body;

the reset element being in contact with the driving rod for driving the drive rod and the actuating member to reset; and the driving rod having the micro-motion contact at a rear end facing the second micro-motion switch is attached to the switch bracket and the main body.

2. The control and protection mechanism of claim 1, wherein the driving rod has a sliding groove formed proximate to the micro-motion contact, and the lock pin has a push block formed at one end and extending into the sliding groove.

3. The control and protection mechanism of claim 2, wherein the first micro-motion switch is a normally closed switch, and the second micro-motion switch is a normally open switch.

4. The control and protection mechanism of claim 1, further comprising a drive element disposed at one end of the lock pin for driving the lock pin to move.

5. The control and protection mechanism of claim 4, further comprising a fixed bracket disposed on the main body such that the reset element is located between the fixed bracket and the driving rod, and the drive element is located between the lock pin and the fixed bracket.

6. The control and protection mechanism of claim 5, wherein the reset element is a reset spring, and the drive element is a drive spring, the maximum elastic force of the reset spring is greater than that of the drive spring.

7. The control and protection mechanism of claim 1, wherein the actuating member includes a pressing piece at the front end, and the front end of the main body is provided with a muzzle, an outer end of the pressing piece extends out of the muzzle.

8. The control and protection mechanism of claim 1, further comprising an adjustment component including an adjustment screw and an adjustment nut, wherein the front end of the driving rod is connected to the actuating member through an adjustment component, wherein the drive rod is connected to the adjustment nut, and the actuating member is connected to the adjusting screw.

9. A nail gun, comprising:

a main body comprising an energy storage mechanism at a rear end portion and a muzzle at a front end portion, wherein the energy storage mechanism comprises a cylinder defined in the rear end portion of the main body and at least one spring disposed in the cylinder;

a striking mechanism comprising a piston disposed in the cylinder, a nail striking member co-movably connected to the piston, and a driving member operably alternatively engaged and disengaged with the nail striking member, wherein an engagement of the driving member with the nail striking member causes the piston to move backward in the cylinder to push the at least one spring into a contract state so as to store energy therein, and an disengagement of the driving member with the nail striking member causes the least one spring to release the stored energy therein to push the piston to move frontward in the cylinder so that the nail striking member is co-moved therewith to strike a nail out of a muzzle;

a control and protection mechanism for controlling and protecting the operation of the nail gun;

wherein the control and protection mechanism comprises a first micro-motion switch, a second micro-motion switch, a switch bracket, a toggle block, a lock pin, an actuating member, a micro-motion contact and a driving rod, wherein the switch bracket is attached to the main body;

the first micro-motion switch and the second micro-motion switch are fixed on the switch bracket;

the toggle block is rotatably attached to the switch bracket, and includes a lock groove, a trigger end and a toggle end, wherein the toggle end is operably coupled to the first micro-motion switch and the trigger end extends into inside the main body such that when the piston moves in the cylinder to a position, the piston pushes the trigger end to prompt the toggle block to rotate and therefore the toggle end to move, thereby causing the first micro-motion switch to change its switch state;

the lock pin is movably attached to the switch bracket and operably extends into the lock groove to prevent the toggle block from rotating;

the actuating member is attached to a front end of the driving rod and extends to a front end of the main body;

the reset element being in contact with the driving rod for driving the drive rod and the actuating member to reset; and the driving rod having the micro-motion contact at a rear end facing the second micro-motion switch is attached to the switch bracket and the main body.

10. The nail gun of claim 9, wherein the driving rod has a sliding groove formed proximate to the micro-motion contact, and the lock pin has a push block formed at one end and extending into the sliding groove.

11. The nail gun of claim 10, wherein the first micro-motion switch is a normally closed switch, and the second micro-motion switch is a normally open switch.

12. The nail gun of claim 9, wherein the control and protection mechanism further comprises a drive element disposed at one end of the lock pin for driving the lock pin to move.

13. The nail gun of claim 12, wherein the control and protection mechanism further comprises a fixed bracket disposed on the main body such that the reset element is located between the fixed bracket and the driving rod, and the drive element is located between the lock pin and the fixed bracket.

14. The nail gun of claim 13, wherein the reset element is a reset spring, and the drive element is a drive spring, the maximum elastic force of the reset spring is greater than that of the drive spring.

15. The nail gun of claim 9, wherein the actuating member includes a pressing piece at the front end, and the front end of the main body is provided with a muzzle, an outer end of the pressing piece extends out of the muzzle.

16. The nail gun of claim 9, wherein the control and protection mechanism further comprises an adjustment component including an adjustment screw and an adjustment nut, wherein the front end of the driving rod is connected to the actuating member through an adjustment component, wherein the drive rod is connected to the adjustment nut, and the actuating member is connected to the adjusting screw.

17. The nail gun of claim 9, wherein the control and protection mechanism comprises a switch bracket and a drive rod disposed on the main body, wherein the switch bracket comprises a micro-motion switch, the drive rod comprises a micro-motion contact facing the micro-motion switch, a stop and a first return spring disposed between the micro-motion contact and the stop.

18. The nail gun of claim 17, wherein the front end of the driving rod passes through the connection member and is connected to an actuating member through a connecting assembly, wherein the connecting assembly comprises a fixed sleeve connected to the connection member, an adjusting rod disposed in the fixed sleeve, a tightening sleeve rotatably connected to the fixed sleeve and setting on the outer side of the adjusting rod, a fixing tube disposed between the adjusting rod and the tightening sleeve, and a second return spring sleeved on the outer side of the fixing tube, wherein an outer end of the adjusting rod is connected to the actuating member.

* * * * *